US011112708B2

(12) United States Patent
Uratani et al.

(10) Patent No.: US 11,112,708 B2
(45) Date of Patent: Sep. 7, 2021

(54) TONER

(71) Applicant: CANON KABUSHIKI KAISHA, Tokyo (JP)

(72) Inventors: Kozue Uratani, Mishima (JP); Daisuke Yoshiba, Suntou-gun (JP); Shohei Tsuda, Suntou-gun (JP); Tomoya Nagaoka, Tokyo (JP); Mariko Yamashita, Suntou-gun (JP); Kazuki Kaneko, Tokyo (JP); Ryo Nagata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/777,087

(22) Filed: Jan. 30, 2020

(65) Prior Publication Data

US 2020/0166861 A1 May 28, 2020

Related U.S. Application Data

(63) Continuation of application No. PCT/JP2018/029215, filed on Aug. 3, 2018.

(30) Foreign Application Priority Data

Aug. 4, 2017 (JP) ..... JP2017-151594
Aug. 4, 2017 (JP) ..... JP2017-151621
Jun. 11, 2018 (JP) ..... JP2018-111474

(51) Int. Cl.
*G03G 9/08* (2006.01)
*G03G 9/097* (2006.01)

(52) U.S. Cl.
CPC ..... *G03G 9/0825* (2013.01); *G03G 9/0827* (2013.01); *G03G 9/097* (2013.01); *G03G 9/09716* (2013.01); *G03G 9/09725* (2013.01)

(58) Field of Classification Search
None
See application file for complete search history.

(56) References Cited

U.S. PATENT DOCUMENTS 4,950,573 A * 8/1990 Yamaguchi ..... G03G 9/0825 430/110.2
6,197,466 B1 * 3/2001 Fields ..... G03G 9/0825 430/111.33

(Continued)

FOREIGN PATENT DOCUMENTS

JP H04-081771 3/1992
JP 04309961 A * 11/1992

(Continued)

OTHER PUBLICATIONS

English language machine translation of JP-04309961-A (Year: 1992).*

*Primary Examiner* — Christopher D Rodee
(74) *Attorney, Agent, or Firm* — Venable LLP

(57) ABSTRACT

A toner comprising a toner particle including a binder resin and a colorant and an external additive, wherein the external additive contains an external additive A having a Feret diameter of 60 to 200 nm, the external additive A is inorganic fine particles or organic-inorganic composite fine particles, adhesion index of the external additive A to the toner is 0.00 to 3.00, and penetration depth b and protrusion height c satisfy Relational expressions (1) and (2) below, where b (nm) denotes penetration depth of the external additive A, at a portion of the external additive A penetrating into the toner particle interior from the surface thereof, and c (nm) denotes a protrusion height of the external additive A at that portion, in an observation of an image resulting from image processing of a cross section of the toner using TEM;

$$60 \le b+c \le 200 \quad (1),$$

$$0.15 \le b/(b+c) \le 0.30 \quad (2).$$

10 Claims, 4 Drawing Sheets

(56) References Cited

U.S. PATENT DOCUMENTS 6,613,491 B2 9/2003 Inoue et al.
7,537,877 B2 5/2009 Yoshiba et al.
7,544,455 B2 6/2009 Yoshiba et al.
7,700,254 B2 4/2010 Moribe et al.
7,740,998 B2 6/2010 Yamazaki et al.
7,796,926 B2 9/2010 Matsuda et al.
7,855,042 B2 12/2010 Kobori et al.
8,043,781 B2 * 10/2011 Imafuku ..... G03G 9/09708 430/111.3
8,057,977 B2 11/2011 Moribe et al.
8,703,378 B2 4/2014 Satoh et al.
8,918,035 B2 12/2014 Hasegawa et al.
9,097,998 B2 8/2015 Yamazaki et al.
9,128,400 B2 9/2015 Takahashi et al.
9,201,323 B2 12/2015 Nishikawa et al.
9,244,371 B2 1/2016 Suzumura et al.
9,250,548 B2 2/2016 Nomura et al.
9,261,804 B2 2/2016 Yamazaki et al.
9,304,422 B2 4/2016 Matsui et al.
9,341,970 B2 5/2016 Yoshiba et al.
9,348,246 B2 5/2016 Magome et al.
9,354,545 B2 5/2016 Matsui et al.
9,377,708 B2 6/2016 Magome et al.
9,423,711 B2 8/2016 Uratani et al.
9,423,712 B2 8/2016 Sugama et al.
9,442,416 B2 9/2016 Magome et al.
9,470,993 B2 10/2016 Nishikawa et al.
9,557,673 B2 * 1/2017 Matsumura ..... G03G 9/0819
9,575,425 B2 2/2017 Naka et al.
9,588,450 B2 3/2017 Tsuda et al.
9,606,462 B2 3/2017 Nomura et al.
9,625,842 B2 4/2017 Uratani et al.
9,658,546 B2 5/2017 Tanaka et al.
9,715,188 B2 7/2017 Terauchi et al.
9,772,570 B2 9/2017 Tsuda et al.
9,778,583 B2 10/2017 Terauchi et al.
9,804,514 B2 10/2017 Suzumura et al.
9,829,818 B2 11/2017 Yoshiba et al.
9,841,692 B2 12/2017 Hasegawa et al.
9,857,707 B2 1/2018 Tsuda et al.
9,904,195 B2 2/2018 Matsui et al.
9,964,874 B2 5/2018 Suzumura et al.
9,971,263 B2 5/2018 Fukudome et al.
10,012,919 B2 7/2018 Matsui et al.
10,156,800 B2 12/2018 Tsuda et al.
10,197,934 B2 2/2019 Matsui et al.
10,228,627 B2 3/2019 Nagashima et al.
10,295,920 B2 5/2019 Nishikawa et al.
10,303,075 B2 5/2019 Tanaka et al.
10,310,397 B2 6/2019 Sano et al.
10,578,990 B2 3/2020 Tsuda et al.
2003/0219667 A1 * 11/2003 Matsumoto ..... G03G 9/09716 430/108.7
2005/0147908 A1 * 7/2005 Yamane ..... G03G 9/09708 430/108.3
2006/0216624 A1 * 9/2006 Ueda ..... G03G 9/08791 430/108.4
2011/0151368 A1 6/2011 Hong et al.
2012/0219892 A1 8/2012 Ohno et al.
2013/0183617 A1 7/2013 Eida et al.
2013/0252167 A1 9/2013 Moribe et al.
2014/0004460 A1 1/2014 Yoshiba et al.
2015/0086917 A1 3/2015 Iwasaki et al.
2015/0125790 A1 5/2015 Hotta et al.
2015/0185658 A1 7/2015 Wakabayashi et al.
2015/0220013 A1 8/2015 Nishikawa et al.
2015/0227069 A1 8/2015 Sugama et al.
2016/0041482 A1 * 2/2016 Terauchi ..... G03G 9/09 430/108.6
2016/0091809 A1 3/2016 Tsuda et al.
2016/0139522 A1 5/2016 Yoshiba et al.
2016/0161874 A1 6/2016 Yamazaki et al.
2016/0202624 A1 7/2016 Nishikawa et al.
2016/0266509 A1 9/2016 Sano et al.
2016/0378003 A1 12/2016 Arimura et al.
2017/0160662 A1 6/2017 Nagashima et al.
2018/0004108 A1 1/2018 Tsuda et al.
2018/0004109 A1 1/2018 Matsui et al.
2018/0024454 A1 * 1/2018 Ojima ..... G03G 9/0825 430/108.1
2018/0173125 A1 6/2018 Fukudome et al.
2018/0173126 A1 6/2018 Ohmori et al.
2018/0246430 A1 8/2018 Tanaka et al.
2018/0246432 A1 8/2018 Nishikawa et al.
2019/0041762 A1 2/2019 Yoshiba et al.
2019/0041763 A1 2/2019 Tsuda et al.
2019/0155181 A1 5/2019 Nagashima et al.
2019/0384194 A1 12/2019 Yoshiba et al.

FOREIGN PATENT DOCUMENTS

JP 2002-214825 7/2002
JP 2005-270955 10/2005
JP 2005-300937 10/2005
JP 2008-164771 7/2008
JP 2009-036980 2/2009
JP 2009-109661 5/2009
JP 2012-063636 3/2012
JP 2013-109018 6/2013
JP 2015-125271 7/2015
JP 2015-152703 8/2015
JP 2016-038591 3/2016
JP 2016-126220 7/2016
JP 2016-139062 8/2016
JP 2016-139063 8/2016
JP 2016-142758 8/2016
JP 2016-142788 8/2016
JP 2016-142811 8/2016
WO 2013/063291 5/2013

* cited by examiner

TONER

CROSS-REFERENCE TO RELATED APPLICATIONS

This application is a Continuation of International Patent Application No. PCT/JP2018/029215, filed Aug. 3, 2018, which claims the benefits of Japanese Patent Application No. 2017-151621, filed Aug. 4, 2017, Japanese Patent Application No. 2017-151594, filed Aug. 4, 2017, and Japanese Patent Application No. 2018-111474, filed Jun. 11, 2018, all of which are hereby incorporated by reference herein in their entirety.

BACKGROUND OF THE INVENTION

Field of the Invention

The present invention relates to a toner used in an image-forming method such as an electrophotographic method.

Background Art

The widespread use of electrophotographic apparatuses such as desktop printers has spurred in recent years a growing diversification in the types of paper that are used.

Where paper of low strength or paper containing a substantial amount of fillers is used, printing tends to be accompanied by generation of a large amount of paper dust.

This paper dust can give rise to various problems in the electrophotographic process.

In particular, in a direct transfer scheme where a toner image is directly transferred from a photosensitive member to paper, the photosensitive member and paper are in direct contact with each other, and accordingly paper dust tends to adhere to the surface of the photosensitive member.

Although paper dust adheres to the surface of the photosensitive member may be recovered in a cleaning process, paper dust that adhered firmly to the surface of the photosensitive member cannot however be fully recovered, which affects charging and development processes. As a result, various image defects such as charging defects and dot-like image blanks are prone to occur.

In a cleaner-less system, moreover, paper dust is not collected in a cleaning process, and accordingly the above impact tends to be pronounced.

In a direct transfer scheme, it is effective to reduce transfer current that is applied in a transfer process, in order to suppress adhesion of paper dust to the surface of the photosensitive member.

However, transfer efficiency tends to drop when transfer current is reduced. In particular, transfer efficiency tends to drop in line images of horizontal lines or vertical images, and improvements in this respect are required.

Proposals focusing on an external addition state of toner have been conventionally made, with a view to improving transfer efficiency. PTL 1 discloses a toner in which a state where an external additive of large particle size is embedded in a toner particle (penetration state) is prescribed. PTL 2 discloses a toner in which there are prescribed a coverage ratio of the surface of a toner particle by inorganic fine particles, and an adhesion ratio of the inorganic fine particles to the toner particle.

CITATION LIST

Patent Literature

PTL 1 Japanese Patent Application Publication No. 2009-036980

PTL 2 Japanese Patent Application Publication No. 2002-214825

PTL 1 and 2 indicates that transfer efficiency is improved through firm adhesion of an external additive of large particle size and that affords a superior spacer function.

In both documents, however, the external additive penetrates deeply into the toner particle because the external additive adheres to the toner particle under the action of strong impact forces. When the external additive penetrates deeply into the toner particle, a sufficient spacer function is difficult to be exerted even when using an external additive of large particle size.

Accordingly, there is room for improvement in terms of improving transfer efficiency at the time of formation of line images in harsher transfer conditions, specifically in low transfer current conditions, envisaged by the inventors.

Although external additives having a spacer function elicit the effect of reducing adhesion between toner particles, the toner of toner images prior to fixing on paper tends however to scatter unless such adhesion is properly regulated.

The present invention provides a toner that is not prone to scatter and that is superior in transfer efficiency during formation of line images under conditions of low transfer current.

SUMMARY OF THE INVENTION

The toner of the present invention is a toner, comprising:

a toner particle that includes a binder resin and a colorant; and an external additive, wherein the external additive contains an external additive A having a Feret diameter of from 60 nm to 200 nm;

the external additive A is inorganic fine particles or organic-inorganic composite fine particles;

an adhesion index of the external additive A to the toner is from 0.00 to 3.00; and a penetration depth b and a protrusion height c satisfy Relational expressions (1) and (2) below, where b (nm) denotes a penetration depth of the external additive A, at a portion of the external additive A penetrating into the interior of the toner particle from the surface of the toner particle, and c (nm) denotes a protrusion height of the external additive A at that portion, in an observation of an image resulting from image processing of a cross section of the toner using a transmission electron microscope (TEM)

$$60 \leq b+c \leq 200 \quad (1)$$

$$0.15 \leq b/(b+c) \leq 0.30 \quad (2).$$

With an outline X defined as the outline of a portion of contact of the external additive A with the toner particle, in the outline of the external additive A, and a line segment Z defined as the line segment obtained by joining both ends of the outline X with a straight line, in the observation of the image resulting from image processing of the cross section, the penetration depth b (nm) of the external additive A denotes a maximum distance between the line segment Z and an intersection of the outline X and a perpendicular line from the line segment Z to the outline X.

With an outline Y defined as the outline of a portion other than the outline X in the outline of the external additive A, in the observation of the image resulting from image processing of the cross section, the protrusion height c (nm) of the external additive A denotes a maximum distance between the line segment Z and an intersection of the outline Y and a perpendicular line from the line segment Z to the outline Y.

Further features of the present invention will become apparent from the following description of exemplary embodiments with reference to the attached drawings.

DESCRIPTION OF THE EMBODIMENTS

Figure 1A:
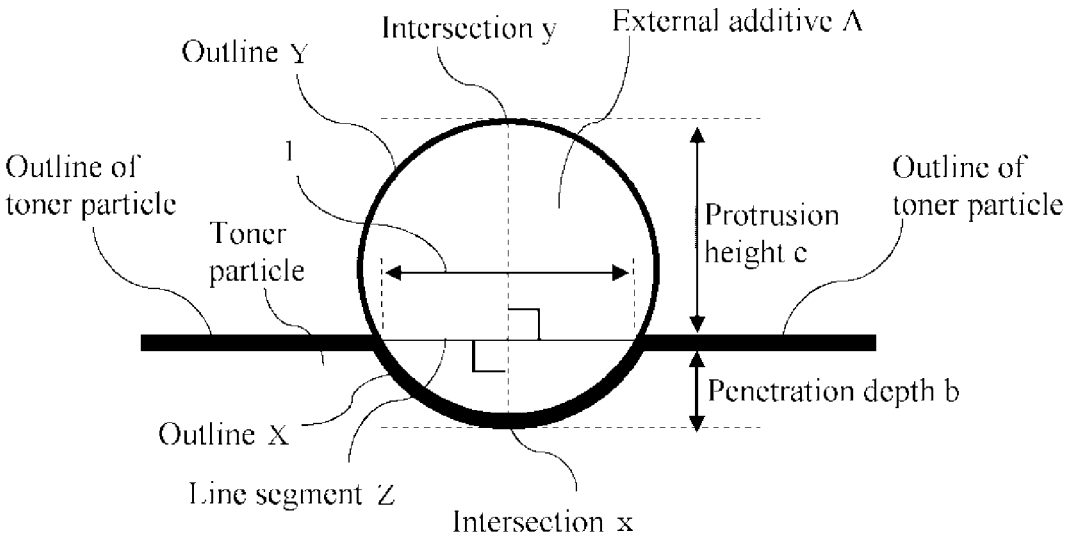
FIGS. 1A and 1B are schematic diagrams illustrating a method for calculating various indices, such as a penetration depth, of an external additive A.

Unless otherwise stated, the notations "from XX to YY" and "XX to YY" representing a numerical range denote in the present invention a range that includes the lower limit and the upper limit thereof, as endpoints.

As described above, in a direct transfer method it is effective to reduce transfer current in order to suppress adhesion of paper dust to a photosensitive member. When transfer current is reduced, however, electrostatic forces for transferring a toner image from the photosensitive member to paper are weaker, and accordingly transfer efficiency tends to drop. Transfer efficiency is also influenced by the image to be outputted. For instance, drops in transfer efficiency tend to be more detrimental in line images, with horizontal or vertical lines, than in the case of full solid images. That is because electric field lines accumulate at the edges of the electrostatic latent image, on the surface of the photosensitive member, and the image is developed with toner unevenly biased towards the edge of the image because development by toner takes place along electric field lines. This phenomenon of development with uneven toner bias is referred to as "edge effect". In images with numerous edges, such as line images, the amount of toner on the photosensitive member increases on account of the edge effect, and electrostatic attachment forces to the photosensitive member tend to be strong, which makes transfer efficiency likely to decrease as a result. This drop in transfer efficiency is prominent in low-temperature, low-humidity environments.

Therefore, the inventors studied diligently how to improve transfer efficiency not only in solid images, but also in line images, even under conditions of low transfer current.

Controlling the structure each of the surface of the toner particle is important in order to raise transfer efficiency. Namely, it is effective to reduce attachment forces between the photosensitive member and the toner.

In order to reduce attachment forces it is effective to reduce the contact area between the toner and the photosensitive member by using an external additive having a large particle size, of about 100 nm (from about 60 to 200 nm), and which delivers a superior spacer function.

However, external additives of large particle size have low fixability to toner particles, and the spacer function of the external additive is difficult to bring out with repeated use.

A mainstream conventional method for addressing the above problem involves imparting strong impact forces during an external addition step, to thereby increase the adhesion ratio of the external additive of large particle size. This method allows increasing the adhesion ratio of external additive of large particle size, and enhancing transfer efficiency, under certain transfer conditions.

Although in the above-described conventional method the adhesion ratio of external additive of large particle size is increased, however, in some instances the external additive readily penetrates deep into the toner particle, and the expected spacer function may fail to be sufficiently elicited. Accordingly, the above method is insufficient as a method for bringing out a spacer function in harsher transfer conditions.

Moreover, the external additive is caused to adhere by strong impact forces, and hence the interface between the toner particle and the external additive of large particle size exhibits significant deformation, and strain arises in the toner particle. This strain becomes greater with increasing depth of penetration of the external additive into the toner particle. With repeated use, the portion of the toner particle at the above interface may crack or break readily, which tends to induce breakage of the toner particle, and for instance to give rise to fogging that accompanies charging defects.

As described above, it has conventionally been difficult to achieve the goal of suppressing deep penetration of an external additive of large particle size into a toner particle while the external additive is strongly adhered to the toner particle.

The inventors found that the above problem can be solved by a toner having the following features.

That is, the toner of the present invention is a toner, comprising:

a toner particle that includes a binder resin and a colorant; and an external additive, wherein the external additive contains an external additive A having a Feret diameter of from 60 nm to 200 nm;

the external additive A is inorganic fine particles or organic-inorganic composite fine particles;

an adhesion index of the external additive A to the toner is from 0.00 to 3.00; and a penetration depth b and a protrusion height c satisfy Relational expressions (1) and (2) below, where b (nm) denotes a penetration depth of the external additive A, at a portion of the external additive A penetrating into the interior of the toner particle from the surface of the toner particle, and c (nm) denotes a protrusion height of the external additive A at that portion, in an observation of an image resulting from image processing of a cross section of the toner using a transmission electron microscope (TEM)

$$60 \leq b+c \leq 200 \quad (1)$$

$$0.15 \leq b/(b+c) \leq 0.30 \quad (2).$$

Here, with an outline X defined as the outline of a portion of contact of the external additive A with the toner particle, in the outline of the external additive A, and a line segment Z defined as the line segment obtained by joining both ends of the outline X with a straight line, in the observation of the image resulting from image processing of the cross section, the penetration depth b (nm) of the external additive A denotes a maximum distance between the line segment Z and an intersection of the outline X and a perpendicular line from the line segment Z to the outline X.

Moreover, with an outline Y defined as the outline of a portion other than the outline X in the outline of the external additive A, in the observation of the image resulting from image processing of the cross section, the protrusion height c (nm) of the external additive A denotes a maximum distance between the line segment Z and an intersection of the outline Y and a perpendicular line from the line segment Z to the outline Y.

It was found that in the present invention, transfer efficiency at the time of formation of line images in harsher conditions, specifically in low transfer current conditions, could be improved by combining, at a high level, suppression of deep penetration of an external additive of large particle size into the toner particle, and strong adhesion of the external additive.

The toner has the external additive A as an external additive of large particle size having a spacer function.

The external additive A must deliver a spacer function and must have mechanical strength; therefore, inorganic fine particles or organic-inorganic composite fine particles are used as the external additive A.

As the particle size of the external additive A, a Feret diameter a of the external additive A is from 60 nm to 200 nm. Preferably, the Feret diameter a is from 70 nm to 150 nm, and more preferably from 80 nm to 120 nm. The Feret diameter a (nm) of the external additive A denotes herein the maximum diameter of the external additive A in an observation of a cross section of a toner particle using a transmission electron microscope (TEM). The above particle size is suitable for an external additive A as an external additive of large particle size that elicits a spacer function.

An adhesion index of the external additive A to the toner is from 0.00 to 3.00, preferably from 0.10 to 2.50, and more preferably from 0.50 to 2.00.

In order to reliably bring out the spacer function of the external additive A, the external additive A must be firmly adhered to the toner particle. When adhesion of the external additive A is weak, the position of the external additive A may shift when toner particles come into contact with each other; with repeated use, the external additive A may migrate from the surface of the toner towards other members, and the spacer function may fail to be sufficiently exerted. A sufficient spacer function with repeated use can be elicited if the adhesion index of the external additive A is from 0.00 to 3.00.

The adhesion index of the external additive A is used as an index of the adhesion state of the external additive A to the toner particle.

A method for calculating the adhesion index of the external additive A may be as follows.

Firstly, a toner is brought into contact with a substrate, and is pressed against the substrate with a constant force, whereupon the amount of external additive A that has migrated to the substrate is calculated by image analysis. The amount of external additive A that has migrated to the substrate is expressed as an area ratio [A] of the external additive on the substrate. When adhesion of the external additive A to the toner particle is strong, the external additive A does not migrate to the substrate even when the toner is brought into contact with the substrate, and accordingly the area ratio [A] of the external additive A takes on a small value.

The area ratio [A] of the external additive A depends on the amount of the external additive A that is present on the surface of the toner particle, and therefore must be normalized in order to serve as an index. In the present invention a coverage ratio [B] of the toner particle by the external additive A is worked out beforehand by observation, and the adhesion index of the external additive A is calculated using the area ratio [A] of the external additive A on the substrate and the coverage ratio [B] of the external additive A, in accordance with the expression below.

$$\text{Adhesion index of external additive } A = \text{Area ratio } [A] \text{ of external additive } A \text{ on substrate/Coverage ratio } [B] \text{ of external additive } A \times 100$$

The smaller the adhesion index of the external additive A, the more firmly the external additive A is adhered to the toner particle.

The detailed conditions involved are described further on.

A characterizing feature of the toner is that deep penetration of an external additive A of large particle size such as that described above into the toner is suppressed while strong adhesion of the external additive A is achieved.

Figure 1B:
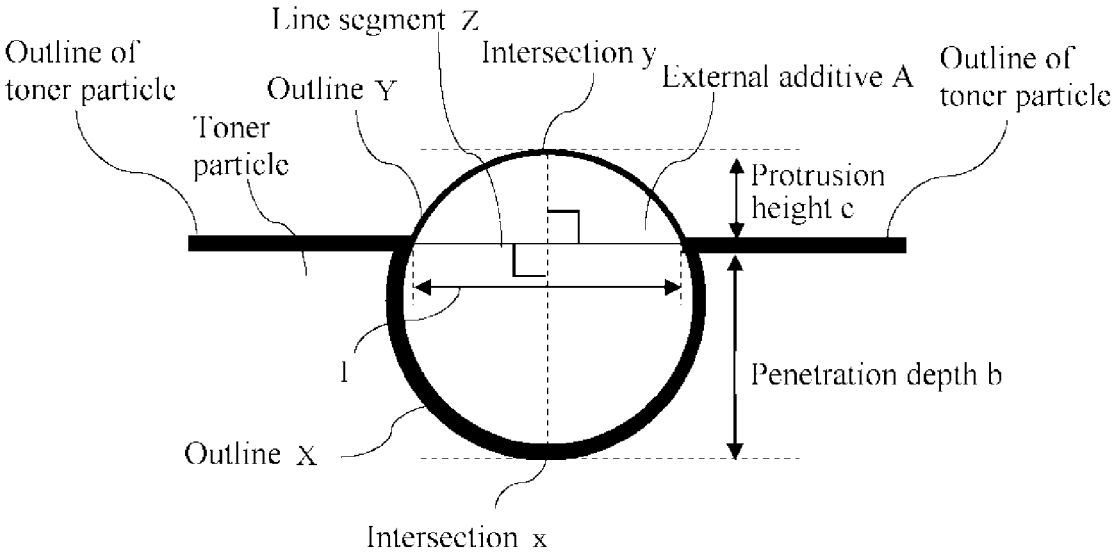

The state of penetration of the external additive A into the toner particle is specified in observations of images resulting from image processing of toner cross sections using a transmission electron microscope (TEM). Specifically, an image is obtained that results from image processing of a cross section of toner containing the external additive A, using a transmission electron microscope (TEM). FIGS. 1A and 1B depict schematic diagrams illustrating a method for calculating various indices, such as a penetration depth, of the external additive A.

In the processed image, b (nm) is defined as the penetration depth, and c (nm) as a protrusion height, of the portion of the external additive A that penetrates into the toner particle from the surface of the toner particle.

A sum b+c (nm) of a penetration depth b (nm) and a protrusion height c (nm) is a value pertaining to the Feret diameter a (nm) of the external additive A. In the present invention, b+c (nm) is from 60 nm to 200 nm, preferably from 70 nm to 150 nm, and more preferably from 80 nm to 120 nm.

A high ratio of the penetration depth b with respect to the sum b+c of the penetration depth b and the protrusion height c of the external additive A indicates herein the external additive A penetrates deeply into the toner particle. In the present invention, the value of a ratio b/(b+c) of the penetration depth b with respect to the sum b+c of the penetration depth b and the protrusion height c, of the external additive A, is used as an index relating to the penetration of the external additive A into the toner particle.

Namely, a larger value b/(b+c) denotes deeper penetration of the external additive A into the toner particle.

A sufficient spacer function can be brought out by prescribing the sum b+c (nm) of the penetration depth b and the protrusion height c of the external additive A to lie in the range from 60 nm to 200 nm, and by prescribing b/(b+c) to be 0.30 or less (preferably 0.28 or less, and more preferably 0.26 or less). However, when the value of b/(b+c) is excessively small the external additive A migrates readily to other members with repeated use, even if the adhesion index is small; therefore, b/(b+c) is 0.15 or higher, preferably 0.18 or higher, and more preferably 0.20 or higher. The above numerical value ranges can be combined arbitrarily.

The degree of penetration of the external additive A into the toner particle, from the surface of the toner particle, while in a state of strong adhesion of the external additive A to the toner particle (adhesion index from 0.00 to 3.00), is controlled by prescribing b/(b+c) to satisfy $0.15 \leq b/(b+c) \leq 0.30$. Thereby, the spacer function of the external additive A can be stably preserved with repeated use. As a result, it becomes possible to achieve improvements in transfer efficiency, under harsher conditions, that were unattainable in conventional art. The value of b/(b+c) can be adjusted through modification of various conditions in the method for causing the external additive A to adhere to the toner particle. Details will be explained further on.

Figure 4:
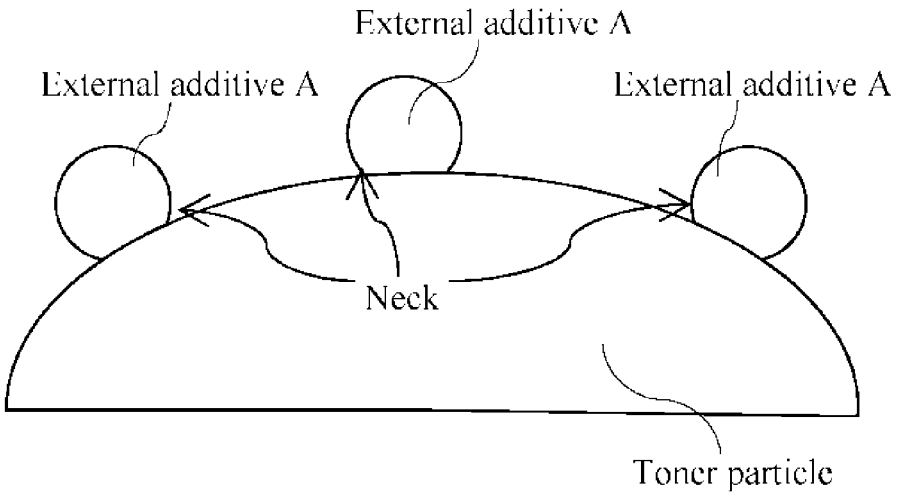
FIG. 4 is a schematic diagram illustrating an example of a penetration state of an external additive A into a toner particle.

Attention has also been paid to the shape of the external additive A adhered to the surface of the toner particle. A neck such as those illustrated in FIG. 4 often forms between the external additive A and the toner particle in the case of adhesion of an external additive A satisfying Relational expressions (1) and (2) to a toner particle. Through formation of such necks, toner particles can readily snag each other in a state where adhesiveness between toner particles is low.

As a result, a loose network of toner particles in the toner image that is formed on the electrostatic latent image is formed, and toner can be made less prone to scatter from the toner image during a developing process or a transfer process.

As described above, thus, by satisfying Expressions (1) and (2) a toner can be provided that is not prone to scatter, and that is superior in transfer efficiency during formation of line images under conditions of low transfer current.

The external additive A is inorganic fine particles or organic-inorganic composite fine particles.

Examples of inorganic fine particles include silica fine particles, alumina fine particles, titania fine particles, as well as complex oxide fine particles of the foregoing.

The method for producing silica fine particles may be for instance:

a combustion method in which the particles are obtained through combustion of a silane compound (namely, a method for producing fumed silica);

a detonation method in which a metallic silicon powder is caused to combust explosively, to yield silica fine particles;

a wet method in which silica fine particles are obtained as a result of a neutralization reaction between sodium silicate and a mineral acid (inorganic acid); and a sol-gel method (so-called Stoeber method) in which silica fine particles are obtained through hydrolysis of an alkoxysilane such as a hydrocarbyloxysilane.

Preferably, the inorganic fine particles are used while having had the hydrophobicity thereof controlled as a result of a hydrophobic treatment.

The method for subjecting the inorganic fine particles to a hydrophobic treatment is preferably a method in which the inorganic fine particles are treated with a hydrophobic treatment agent.

Examples of the organic-inorganic composite fine particles include fine particles of, for instance, an organic inorganic composite material made up of an inorganic material an organic material.

Organic-inorganic composite fine particles have good durability and charging performance, as an inorganic material, while by virtue of being also an organic material of low heat capacity, are not prone to hinder melting or coalescing of toner particles during fixing, and are unlikely to hamper fixing performance.

The organic-inorganic composite fine particles are preferably organic-inorganic composite fine particles resulting from embedding inorganic fine particles on the surface of resin fine particles (preferably vinyl resin fine particles) which are an organic material. More preferably, the particles are organic-inorganic composite fine particles having a structure in which inorganic fine particles are exposed at the surface of vinyl resin particles. Yet more preferably, the particles are organic-inorganic composite fine particles having protruded portions, derived from inorganic fine particles, on the surface of vinyl resin particles.

Preferably, the external additive A is subjected to a hydrophobic treatment using a hydrophobic treatment agent.

Examples of hydrophobic treatment agents include:

chlorosilanes such as methyltrichlorosilane, dimethyldichlorosilane, trimethylchlorosilane, phenyltrichlorosilane, diphenyldichlorosilane, t-butyldimethylchlorosilane and vinyltrichlorosilane;

alkoxysilanes such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyl diethoxysilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane and γ-(2-aminoethyl) aminopropylmethyldimethoxysilane;

silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane and dimethyltetravinyldisilazane;

silicone oils such as dimethyl silicone oil, methylhydrodiene silicone oil, methylphenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil and terminal reactive silicone oil; and siloxanes such as hexamethylcyclotrisiloxane, octamethylcyclotetrasiloxane, decamethylcyclopentasiloxane, hexamethyldisiloxane and octamethyltrisiloxane.

Further examples of hydrophobic treatment agents include salts of fatty acids such as undecyl acid, lauric acid, tridecylic acid, dodecylic acid, myristic acid, palmitic acid, pentadecylic acid, stearic acid, heptadecylic acid, arachidic acid, montanic acid, oleic acid, linoleic acid, arachidonic acid and metals such as zinc, iron, magnesium, aluminum, calcium, sodium and lithium.

Preferred among the foregoing are alkoxysilanes, silazanes and straight silicone oils, because all these can be easily subjected to a hydrophobic treatment. The hydrophobic treatment agent may be used as a single type, or alternatively two or more types may be used concomitantly.

Herein the standard deviation of b/(b+c), which is an index pertaining to the penetration of the external additive A into the toner particle, is preferably 0.00 to 0.13, and more preferably 0.00 to 0.12.

The protrusion height c (nm) is preferably 50.0 nm to 150.0 nm, and more preferably 50.0 nm to 120.0 nm.

The standard from deviation of the protrusion height c is preferably from 0 to 30, and more preferably from 0 to 20.

By controlling the standard deviation of b/(b+c) and the standard deviation of the protrusion height c so as to lie in the above ranges, the degree of penetration of the external additive A into the toner particle and the variability of the protrusion height c are kept small, and the spacer function of the external additive A can be brought out stably. Durability and environment stability are enhanced as a result.

Defining l (nm) as the length of a line segment Z, l/(b+c) is preferably from 0.70 to 0.92, and more preferably from 0.70 to 0.88.

Through setting of l/(b+c) to 0.70 to 0.92 while satisfying relational expressions (1) and (2), a large amount of external additive A becomes adhered to the toner particle, while a moderate neck is formed, and a network can be constructed more stably between toner particles.

The coverage ratio of the surface of the toner particle by the external additive A, worked out through observation by scanning electron microscopy and image measurements is preferably from 4.0 area % to 50.0 area %, and more preferably from 7.0 area % to 36.0 area %. The coverage ratio of the surface of the toner particle by the external additive A can be adjusted by modifying the addition amount of the external additive A and/or external addition conditions.

The coverage ratio is preferably set to 4.0 area % or more, in order to bring out the spacer function of the external additive A. When the coverage ratio is 50.0 area % or less, the external additive A is readily dispersed uniformly on the surface of the toner particle, and the adhesion state on the toner particle is likelier to be uniform.

Figure 2:
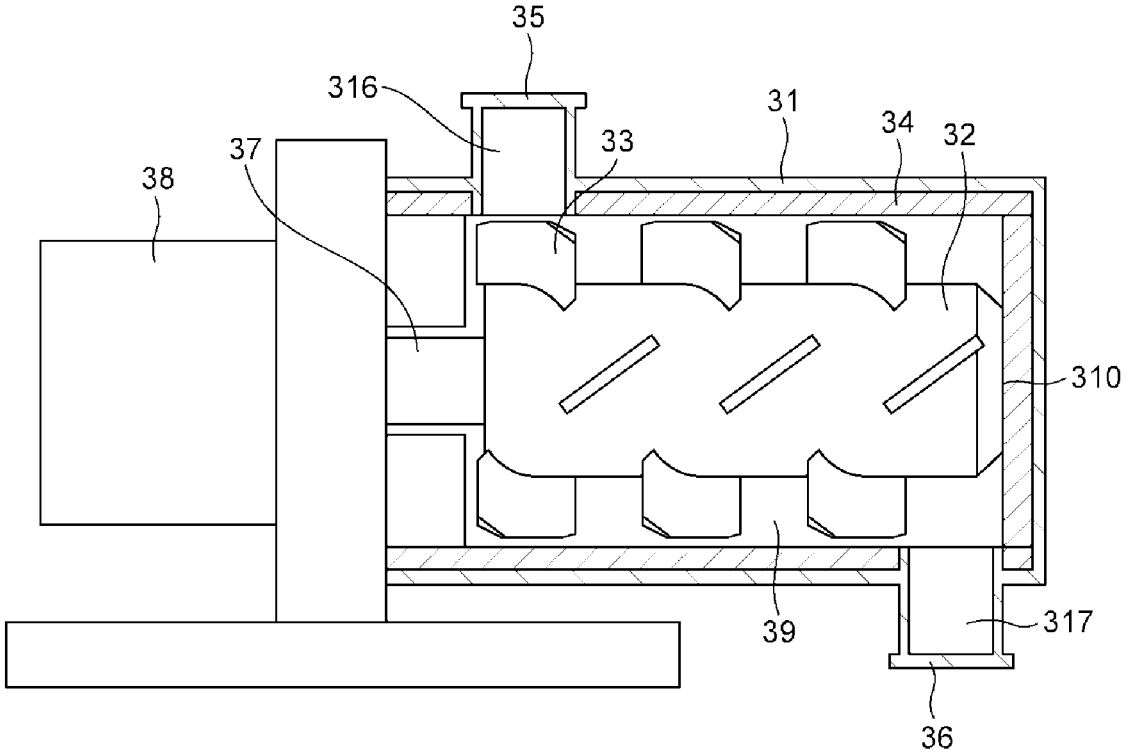
FIG. 2 is a schematic diagram illustrating an example of a mixing processor.
Figure 3:
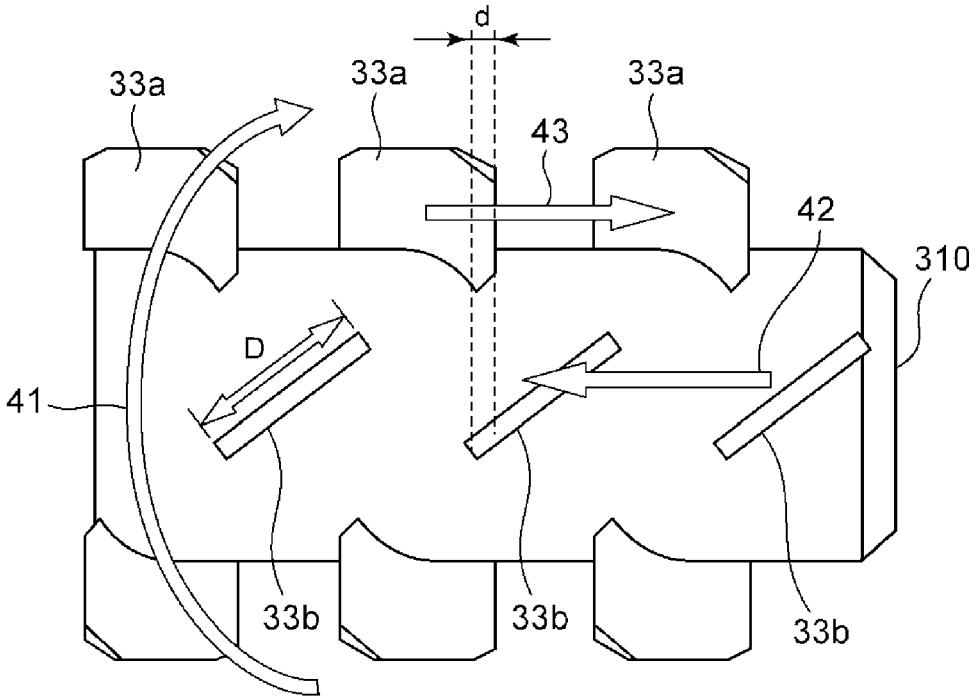
FIG. 3 is a schematic diagram illustrating an example of the configuration of stirring members used in a mixing processor.

A method in which the external additive A is caused to be adhered to the toner particle by heating, using the mixing processor illustrated in FIG. 2 and FIG. 3, is herein a preferred method for causing the external additive A to adhere to the toner particle.

As methods for causing an external additive of large particle size to be firmly adhered to a toner particle, conventional methods mainly resorted to involve increasing impact forces and shear forces between toner and stirring blades, and between toner particles, in the interior of a mixing processor.

As described above, however, in an adhesion method relying on strong impact forces and shear forces, an external additive of large particle size penetrates deeply into the toner particle, and strain is prone to occur at the interface of the toner particle and the external additive of large particle size, and in the interior of the toner particle.

Therefore, the inventors speculated that an external addition method based on a novel idea is required, instead of a conventional adhesion method relying on strong impact forces and/or shear forces, and focused on adhesion by heat, in order to cause the external additive A to be firmly adhered to the toner particle without penetrating deeply into the surface of the toner particle.

When heat is imparted to toner, at around the glass transition temperature (Tg) of the toner particle, the surface of the toner particle softens partially, and immobilization of the external additive A can be promoted.

The adhesion state of the present invention can be achieved if heat can be imparted without exerting impact forces or shear forces on the toner, to the extent possible.

Impact forces and shear forces exerted by the external addition device have also the effect of uniformly dispersing the external additive on the surface of the toner particle. Namely, a method is preferred in which the external additive A is dispersed uniformly on the surface of the toner particle, in a state where no impact forces or shear forces are exerted, to the extent possible.

As an example, such a method may be a method for warming an object to be treated, using the mixing processor illustrated in FIG. 2 and FIG. 3. This method allows controlling the degree of penetration and the adhesion index of the external additive A, while ensuring also uniform dispersibility of the external additive A.

FIG. 2 is a schematic diagram illustrating an example of a mixing processor.

FIG. 3 is a schematic diagram illustrating an example of the configuration of stirring members used in the mixing processor illustrated in FIG. 2.

The mixing processor illustrated in FIG. 2 has a rotating member 32 having a plurality of stirring members 33 disposed on the surface, a drive member 38 which rotationally drives the rotating member, and a body casing 31 provided so as to leave a gap with the stirring members 33.

At the gap (clearance) between the inner periphery of the body casing 31 and the stirring members 33, the toner particle is heated efficiently and shear is applied uniformly to the toner particle, so that an external additive can be caused to adhere to surface of the toner particle while the external additive is broken up from secondary particles to primary particles.

As described below, the toner particle and the external additive circulate readily in the axial direction of the rotating member, and are readily mixed with each other, sufficiently uniformly, before adhesion of the external additive to the toner particle advances.

The diameter of the inner periphery of the body casing 31 in this mixing processor is twice or less the diameter of the outer periphery of the rotating member 32. FIG. 2 illustrates an example in which the diameter of the inner periphery of the body casing 31 is 1.7 times the diameter of the outer periphery of the rotating member 32 (diameter of the body of the rotator 32 excluding the stirring members 33). When the diameter of the inner periphery of the body casing 31 is twice or less the diameter of the outer periphery of the rotating member 32, a treatment space where forces act on the toner particle is moderately restricted and, as a result, the external additive constituting secondary particles can be sufficiently dispersed.

Preferably, the above clearance is adjusted in accordance with the size of the body casing. The size of the clearance is suitably from 1% to 5% of the diameter of the inner periphery of the body casing 31 because in that case heat is efficiently imparted to the toner particle. Specifically, in a case where the diameter of the inner periphery of the body casing 31 is about 130 mm, the clearance may be set to from about 2 mm to 5 mm, while in a case where the inner periphery of the body casing 31 is about 800 mm, the clearance may be set to from about 10 mm to 30 mm.

As illustrated in FIG. 3, at least some of the plurality of stirring members 33 are formed as feeding stirring members **33*a* for feeding the toner particle in the axial direction of the rotating member, accompanying rotation of the rotating member 32. Moreover, at least some of the plurality of stirring members 33** are formed as return stirring members 33*b* for returning the toner particle in a direction other than the axial direction of the rotating member, accompanying rotation of the rotating member 32. In a case where a starting material inlet 35 and a product outlet 36 are provided at respective ends of the body casing 31, as illustrated in FIG. 2, the direction from the starting material inlet 35 towards the product outlet 36 (rightward direction in FIG. 2) is referred to as "feed direction".

Namely, the plate surface of the feeding stirring members 33*a* is tilted so as to feed the toner particle in a feed direction 43, as illustrated in FIG. 3. By contrast, the plate surface of the stirring members 33*b* is tilted so as to feed the toner particle in a return direction 42.

As a result, a warming treatment is performed while feeding in the feed direction 43 and feeding in the return direction 42 are carried out repeatedly. The stirring members 33*a* and 33*b* form respective sets of a plurality of members spaced apart from each other in the circumferential direction of the rotating member 32. In the example illustrated in FIG. 3, the stirring members 33*a*, 33*b* form respective sets of two members that are spaced by 180 degrees from each other, on the rotating member 32, but may form sets of multiple members, for instance sets of three members spaced from each other by 120°, or sets of four members spaced from each other by 90°.

In the example of the stirring members illustrated in FIG. 3 there are formed a total of 12 equally spaced stirring members 33*a* and 33*b*.

In FIG. 3, D represents the width of each stirring member, and d represents a distance denoting the overlap between the stirring members. Herein, D is preferably from about 20% to 30% of the length of the rotating member 32, from the viewpoint of efficiently feeding the toner particle in the feed direction and the return direction. FIG. 3 illustrates an example in which D is 23% of the length of the rotating member 32. Preferably, a certain overlap portion d between respective stirring members 33*b* and stirring members 33*a* exists when drawing an extension line from the end position of each stirring member 33*a* in the vertical direction.

As a result, the external additive can be efficiently dispersed on the surface of the toner particle. Preferably, a ratio of d with respect to D ((d/D)×100) is from 10% to 30%, from the viewpoint of applying appropriate shear.

Other than a shape such as that illustrated in FIG. 3, the blades may take on a shape such that the toner particle can be fed in the feed direction and the return direction. So long as a clearance can be maintained, the shape of the blades may be for instance a curved surface shape, or a paddle structure shape in which a tip blade portion is joined to the rotating member 32 at a rod-like arm.

The mixing processor illustrated in FIG. 2 further has a jacket 34 inward of the body casing 31 and adjacent to a rotating member end side face 310, such that a cooling/heating medium can flow through the jacket 34.

The mixing processor illustrated in FIG. 2 further has a starting material inlet 35 formed at the top of the body casing 31 and a product outlet 36 formed and the bottom of the body casing 31. The starting material inlet 35 is used in order to introduce the toner particle and the external additive. The product outlet 36 is used in order to discharge toner having undergone a mixing treatment (external addition treatment) to the exterior of the body casing 31.

In the mixing processor illustrated in FIG. 2, a starting material inlet inner piece 316 is inserted in the starting material inlet 35, and a product outlet inner piece 317 is inserted in the product outlet 36.

Firstly the starting material inlet inner piece 316 is removed from the starting material inlet 35, the toner particle and the external additive are charged into the treatment space 39 through the starting material inlet 35, and the starting material inlet inner piece 316 is inserted. Next, the rotating member 32 is rotated by the drive member 38 (the reference symbol 41 denotes the rotation direction), to perform a warming and mixing process of the toner particle and external additive that have been charged, while under mixing through stirring by a plurality of stirring members 33 provided on the surface of the rotating member 32.

Through the use of the above mixing processor of superior diffusion ability it becomes possible to break up the external additive from secondary particles into primary particles, with the minimum required impact forces and shear forces. As a result, the external additive becomes uniformly dispersed on the surface of the toner particle.

Warming is performed by causing moderate-temperature warm water to flow through the jacket 34. The temperature of the warm water is monitored by a thermocouple disposed inside the starting material inlet inner piece 316.

In order to obtain a toner stably, the thermocouple temperature (T1) of the starting material inlet inner piece 316 is preferably T2−10° C. to T2+10° C., where T2 denotes the glass transition temperature of the toner particle. More preferably, the thermocouple temperature (T1) is T2−10° C. to T2+5° C.

When T1 is T2−10° C. or higher, the surface of the toner particle is softened readily and the external additive becomes adhered readily, and transfer of external additive to other members due to repeated use is suppressed.

If T1 is T2+10° C. or lower, it is difficult to elicit melt adhesion inside the process apparatus because T1 does not exceed significantly the glass transition temperature of the toner particle. Moreover, the external additive becomes less prone to penetrate deeply into the toner particle, and the spacer function of the external additive is likely to be sufficiently brought out.

The peripheral velocity V of the plurality of stirring blades of the mixing processor illustrated in FIG. 2 and FIG. 3 is preferably from 0.1 m/s to 7.0 m/s. A mixing process energy E (Wh/g) at the time of heated mixing preferably satisfies Expression (3) below.

$$1.0\times10^{-4}\,Wh/g \le E \le 1.5\times10^{-2}\,Wh/g \quad (3)$$

In Expression (3) above, E is a value resulting from multiplying, by time (h), effective power (W) resulting from subtracting idle power (W) of an operation where no toner particle is inputted, from power (W) when a toner particle is inputted, and by dividing the multiplication result by a toner particle input amount (g).

Upon high-speed collision of the stirring blades against the toner particle and the external additive, the external additive penetrates deeply into the toner particle from the surface of the toner particle as described above; thus, the spacer function of the external additive is impaired, and a nonuniform external addition state of the external additive is prone to occur. Residual stress accumulates at the interface between the toner particle and the external additive, and/or inside the toner, and toner breakage/chipping is prone to occur with repeated use.

The degree of penetration of the external additive can be controlled to be moderate, while achieving strong and uniform adhesion of the external additive to the toner particle, by controlling the peripheral velocity of the plurality of stirring blades, the process power and process time of the mixing processor, as well as a treatment energy calculated on the basis of a treatment amount, so as to lie within the above ranges.

The process time is preferably from 3 minutes to 30 minutes, and more preferably from 3 minutes to 10 minutes. Toner strength and moderate adhesion of the external additive can be both achieved readily by controlling the process time to lie within the above range.

As described above, through external addition of the external additive A while under warming using the above mixing processor superior in diffusibility and circulation properties, it becomes possible to disperse uniformly the external additive A on the surface of the toner particle, with the minimum necessary impact forces and shear forces, and a strong adhesion state of the external additive A can be achieved in a short time.

An external addition treatment and a warming treatment may be performed simultaneously using the above mixing processor, or alternatively the toner particle and the external additive A may be mixed, and an external addition treatment be carried out, using a mixer such as a Henschel mixer, followed by a warming treatment using the above mixing processor.

Examples of mixers include the following:

Mitsui Henschel Mixer (by Mitsui Miike Kakoki K. K.);

Super mixer (by Kawata Manufacturing Co., Ltd.);

Ribocorn (by Okawara Manufacturing Co., Ltd.);

Nauta Mixer, Turbulizer and Cyclomix (by Hosokawa Micron Corporation);

Spiralpin Mixer (by Pacific Machinery & Engineering Co., Ltd.); and

Lodige Mixer (by Matsubo Corporation).

In a preferred treatment method, the toner particle and the external additive A are mixed, and an external addition treatment is carried out, using a mixer such as a Henschel mixer, followed by a warming treatment using the above mixing processor.

A shape factor SF-2 of the external additive A, measured using a scanning electron microscope (SEM), is preferably from 100 to 120, and more preferably from 110 to 120. A shape factor SF-2 lying within the above range denotes that the external additive A juts beyond the surface of the toner particle, and has a protruding structure. The shape factor SF-2 can be adjusted through modification of the production conditions of the external additive A.

Transfer efficiency can be enhanced, and the flowability of toner improved, when using an external additive A having a shape factor SF-2 from 100 to 120 (more preferably from 110 to 120). As a result, stable charging performance with repeated use can be achieved, and variations in image density can be suppressed.

A method for measuring the shape factor SF-2 will be described below.

By adopting a structure in which the external additive A protrudes out, an anchoring effect on the surface of the toner particle is readily achieved, adhesion can be controlled easily, and resistance towards external shear is increased, and durability test stability is enhanced as a result.

In a measurement of the strength of the toner in accordance with a nanoindentation method, preferably a load F at a maximum value of a differential curve obtained through differentiating, by load, of a load-displacement curve with load (mN) on the horizontal axis and displacement amount (μm) on the vertical axis, is from 0.8 mN to 2.0 mN, in a load region from 0.20 mN to 2.30 mN. More preferably, the load F is 1.0 mN or larger. More preferably, the load F is 1.5 mN or smaller.

Breakage and collapse of toner derived from repeated use can be suppressed by increasing the mechanical strength of the toner through control of the adhesion state of the external additive A in the above manner. Breakage and collapse of toner readily cause charging defects, which give rise to image defects such as fogging. Breakage and collapse of toner derived from repeated use are exacerbated in low-temperature environments.

In order to achieve high-definition images even with repeated use it is also important to control the mechanical strength of the toner.

For instance, the molecular weight of the binder resin is also influential as an underlying factor of lowered mechanical strength of the toner; however, mechanical strength is likewise readily affected by strain and stress accumulated in the interior of the toner in the toner production process. In particular, stress is likely to remain in the interior of the toner when strong forces act on the toner.

A nanoindentation method has been used as an index of toner strength. Nanoindentation is an evaluation method in which a diamond indenter is pushed into a sample disposed on a stage, load (strength of indentation) and displacement (depth of indentation) are measured, and mechanical properties are analyzed on the basis of the obtained load-displacement curve.

Conventionally micro-compression testers are often used as a method for evaluating the mechanical characteristics of toners. Indenters used in micro-compression tests are larger than the size of ordinary toner particles, and accordingly are suitable for evaluation of macro-mechanical characteristics of toner.

However, the micro-mechanical characteristics of the surface of or the toner particle exert an influence on the breakage and collapse of toner, in particular on breakage, and accordingly characteristic evaluation in yet finer regions is required herein. In a measurement by nanoindentation, the indenter has a triangular pyramid shape, the tip of the indenter being much smaller than the size of the toner particle. Accordingly, such an indenter is suitable for evaluation of the micro-mechanical characteristics of the surface of a toner particle.

In a measurement by nanoindentation, a very small load is applied continuously to the toner, to thereby push the indenter into the sample, the displacement of the indenter is measured, and a load-displacement curve is constructed with load (mN) on the horizontal axis and displacement amount (μm) on the vertical axis.

The toner particle deforms significantly at the load where displacement with respect to load exhibits a maximum in the load-displacement curve. Namely, it is considered that a phenomenon corresponding to breakage occurs herein. In the present invention, therefore, the load that yields the largest slope on the load-displacement curve has been taken as a load at which breakage of the toner particle can occur. Namely, the larger the load at a largest slope, the greater is the load necessary for breakage of the toner particle, and breakage of the toner particle is unlikelier to occur.

As a method for calculating load at a largest slope, a method has been resorted to in which the load at which a differential value in a differential curve resulting from differentiating a load-displacement curve by load takes on a maximum value is taken as the largest slope.

In order to increase the mechanical strength of the toner, it is effective for instance to increase the molecular weight of the binder resin that is used in the toner particle. However, an excessive increase in molecular weight may result in a drop in fixing performance.

Providing a warming step in or after the external addition step is preferred herein in order to increase the mechanical strength of the toner, without excessively raising the molecular weight. As a result, it becomes possible to relieve the residual stress generated in the production process of the toner, and to promote adhesion of the external additive A by heat.

A method in which the external additive A is caused to be adhered by heat, using the mixing processor illustrated in FIG. 2 and FIG. 3, is preferred because that method allows readily controlling the adhesion ratio and degree of penetration of the external additive A, and also easily controlling the strength of the toner by nanoindentation.

Examples of the binder resin used in the toner particle include:

vinyl resins, styrene resins, styrene copolymer resins, polyester resins, polyol resins, polyvinyl chloride resins, phenolic resins, phenolic resins modified with natural resins, maleic acid resins modified with natural resins, acrylic resins, methacrylic resins, polyvinyl acetate, silicone resins, polyurethane resins, polyamide resins, furan resins, epoxy resins, xylene resins, polyvinyl butyral, terpene resins, coumarone indene resins and petroleum resins.

Preferred among the foregoing are styrene copolymer resins, polyester resins, mixtures of polyester resins and vinyl resins, and hybrid resins resulting from partial reaction of polyester resins and vinyl resins.

The binder resin may be used as a single type, or alternatively two or more types may be used concomitantly.

The toner particle may contain a release agent.

Examples of the release agent include:

waxes having a fatty acid ester as a main component, such as carnauba wax and montanate wax;

wholly or partially deacidified products of fatty acid esters such as deacidified carnauba wax;

methyl ester compounds having hydroxyl groups and obtained by hydrogenation of plant-based oils and fats;

saturated fatty acid monoesters such as stearyl stearate and behenyl behenate;

diesterification products of saturated aliphatic dicarboxylic acids and saturated aliphatic alcohols, such as dibehenyl sebacate, distearyl dodecanedioate and distearyl octadecanedioate;

diesterification products of saturated aliphatic diols and saturated fatty acids, such as nonanediol dibehenate and dodecanediol distearate;

aliphatic hydrocarbon waxes such as low molecular weight polyethylene, low molecular weight polypropylene, microcrystalline waxes, paraffin waxes and Fischer Tropsch waxes;

oxides of aliphatic hydrocarbon waxes such as oxidized polyethylene wax, or block copolymers thereof;

waxes resulting from grafting a vinylic monomer such as styrene or acrylic acid to an aliphatic hydrocarbon wax;

saturated linear fatty acids such as palmitic acid, stearic acid and montanic acid;

unsaturated fatty acids such as brassidic acid, eleostearic acid and parinaric acid;

saturated alcohols such as stearyl alcohol, aralkyl alcohol, behenyl alcohol, carnaubyl alcohol, ceryl alcohol and melissyl alcohol;

polyhydric alcohols such as sorbitol;

fatty acid amides such as linoleamide, oleamide and lauramide;

saturated fatty acid bisamides such as methylene bis(stearamide), ethylene bis(capramide), ethylene bis(lauramide) and hexamethylene bis(stearamide);

unsaturated fatty acid amides such as ethylene bis(oleamide), hexamethylene bis(oleamide) and N,N'-dioleyl adipamide and N,N'-dioleyl sebacamide;

aromatic bisamides such as m-xylene bis(stearamide) and N,N'-distearyl isophthalamide;

aliphatic metal salts (ordinarily referred to as metal soaps) such as calcium stearate, calcium laurate, zinc stearate and magnesium stearate; and long-chain alkyl alcohols or long-chain alkyl carboxylic acids having 12 or more carbon atoms.

Preferred among these releasing agents is a monofunctional or bifunctional ester wax such as a monoester or diesterification product of a saturated fatty acid, a paraffin wax, or a Fischer Tropsch wax.

The release agent may be used as a single type, or alternatively two or more types may be used concomitantly.

The melting point of the release agent defined by a peak temperature of a maximum endothermic peak at the time of a rise in temperature, and measured using a differential scanning calorimeter (DSC), is preferably from 60° C. to 140° C. The melting point is more preferably from 60° C. to 90° C. The storability of the toner is enhanced when the melting point is 60° C. or higher. In contrast, low-temperature fixability can be readily enhanced when the melting point is 140° C. or lower.

The content of the release agent in the toner particle is preferably from 3 parts by mass to 30 parts by mass with respect to 100 parts by mass of the binder resin in the toner particle. Fixing performance improves readily when the content of the release agent is 3 parts by mass or greater. In contrast, the toner is unlikelier to deteriorate after prolonged use, and image stability is readily improved, when the content of the release agent is 30 parts by mass or less.

Preferably, the toner contains a charge control agent.

Preferred examples of a charge control agent for negative charging include organometallic compounds and chelate compounds, for instance monoazo metal complex compounds; acetylacetone metal complex compounds; and metal complex compound of aromatic hydroxycarboxylic acids or aromatic dicarboxylic acids.

Concrete examples of commercial products of charge control agents include

Spilon Black TRH, T-77 and T-95 (by Hodogaya Chemical Co., Ltd.) and BONTRON S-34, S-44, S-54, E-84, E-88 and E-89 (by Orient Chemical Industries Co., Ltd.).

The charge control agent may be used as a single type, or alternatively two or more types may be used concomitantly.

From the viewpoint of the charge quantity of the toner, the content of the charge control agent in the toner particle is preferably from 0.1 parts by mass to 10.0 parts by mass, and more preferably from 0.1 parts by mass to 5.0 parts by mass, relative to 100 parts by mass of the binder resin in the toner particle.

As the toner there can be used any toner from among a magnetic single-component toner, a non-magnetic single-component toner, and a toner for non-magnetic two-component developers.

A magnetic body is preferably used as the colorant in a case where a magnetic single-component toner is used as the toner.

Examples of magnetic bodies used in a magnetic single-component toners include:

magnetic iron oxides such as magnetite, maghemite and ferrite, and magnetic iron oxides including other metal oxides;

metals such as Fe, Co, Ni, or alloys of these metals and Al, Co, Cu, Pb, Mg, Ni, Sn, Zn, Sb, Be, Bi, Cd, Ca, Mn, Se, Ti, W or V, as well as mixtures of the foregoing.

Magnetite is preferred among these magnetic bodies. Examples of the shape of magnetite include polyhedral, octahedral, hexahedral, spherical, needle-like and scale-like shapes. From among these shapes, a less anisotropic shape such as polyhedral, octahedral, hexahedral or spherical shape is preferred in terms of improving image density.

The volume-average particle diameter of the magnetic body is preferably from 0.10 μm to 0.40 μm. When the volume-average particle diameter is 0.10 μm or larger, the magnetic bodies are unlikelier to aggregate, and homogeneous dispersibility of the magnetic body in the toner particle is enhanced. The tinting strength of the toner is enhanced when the volume-average particle diameter is 0.40 μm or smaller.

The volume-average particle diameter of the magnetic body can be measured using a transmission electron microscope. Specifically, a toner particle to be observed is dispersed sufficiently in an epoxy resin, and is thereafter cured in the atmosphere, at a temperature of 40° C. over 2 days, to yield a cured product. The obtained cured product is sliced using a microtome, and the particle size of 100 magnetic bodies is measured in the field of view of a photograph at a magnification from 10,000× to 40,000×, in a transmission electron microscope (TEM). The volume-average particle size is then calculated on the basis of a circle-equivalent diameter that is equal to the projected area of each magnetic body. Alternatively, the volume-average particle diameter of the magnetic body can be measured using an image analysis device.

The content of the magnetic body in the toner particle is preferably from 30 parts by mass to 120 parts by mass, and more preferably from 40 parts by mass to 110 parts by mass, relative to 100 parts by mass of the binder resin in the toner particle.

The magnetic body used in the toner can be produced for instance in accordance with the following method.

To an aqueous solution of a ferrous salt, an alkali such as sodium hydroxide is added, in an amount of one equivalent or more with respect to the iron component, to thereby prepare an aqueous solution containing ferrous hydroxide. Air is blown into the prepared aqueous solution while the pH of the solution is kept at 7 or higher, and an oxidation reaction of the ferrous hydroxide is conducted next, while under warming of the aqueous solution at 70° C. or above, to thereby initially form seed crystals that constitute the cores of the magnetic bodies.

An aqueous solution containing 1 equivalent of ferrous sulfate, referred to the amount of the previously added alkali, is added to a slurry-like solution containing the seed crystals. The reaction of ferrous hydroxide is allowed to proceed while the pH of the solution is maintained at 5 to 10 and air is blown in, to thereby grow magnetic iron oxide particles using the seed crystals as cores. The shape and magnetic characteristics of the magnetic body can be controlled through adjustment of the pH, the reaction temperature and stirring conditions. The pH of the solution becomes increasingly acidic as the oxidation reaction proceeds. The pH of the solution should however not be lower than 5.

A magnetic body can then be obtained by filtering, washing and drying the magnetic iron oxide particles thus obtained.

In a case where the toner is produced in accordance with a polymerization method, the surface of the magnetic body is preferably subjected to a hydrophobic treatment. In the case of a surface treatment by a dry process, the surface of the washed, filtered and dried magnetic body can be subjected to a coupling agent treatment. In the case of a surface treatment by a wet process, once the oxidation reaction is over the resulting dried product is thereafter re-dispersed, or alternatively, the iron oxide obtained through washing and filtration after the oxidation reaction is over is re-dispersed, without being dried, in another aqueous medium, where a coupling treatment can then be performed.

In the case of re-dispersion, specifically, a coupling treatment can be carried out by adding a silane coupling agent while under stirring of the re-dispersed solution, and by raising the temperature after hydrolysis, or alternatively, by adjusting the pH of the re-dispersed solution to an alkaline region.

From the viewpoint of carrying out a uniform surface treatment it is preferable, among the foregoing, to perform filtration and washing once the oxidation reaction is over, and thereafter, to make the product as-is into a re-slurry, without drying, and to perform then a surface treatment.

In a case where the surface treatment of the magnetic body is of wet type, i.e. with a coupling agent in an aqueous medium, firstly the magnetic body is dispersed to a primary particle size in the aqueous medium, and is then stirred using a stirring blade so as to preclude settling and aggregation. Next, an appropriate amount of a coupling agent is added to the dispersion, and the surface treatment is performed while the coupling agent is hydrolyzed; in this case as well, the surface treatment is carried out, while eliciting dispersion so as to preclude aggregation, using a device such as a pin mill or a line mill.

The aqueous medium is a medium having water as a main component. For instance, the aqueous medium may be water itself, a medium of water having a small amount of a surfactant added thereto, a medium of water having a pH adjuster added thereto, or a medium of water having an organic solvent added thereto.

The surfactant is preferably a nonionic surfactant such as polyvinyl alcohol. Preferably, the surfactant is added to the aqueous medium so that the concentration of the surfactant is from 0.1 mass % to 5.0 mass %.

Examples of pH adjusters include inorganic acids such as hydrochloric acid.

Examples of organic solvents include for alcohols.

Examples of the coupling agent that can be used in the surface treatment of the magnetic body include silane coupling agents and titanium coupling agents. Silane coupling agents are preferred among the foregoing, and more preferably silane coupling agent represented by Formula (4) below.

$$R_m—Si—Y_n \quad (4)$$

Where, R represents an alkoxy group (preferably an alkoxy group having from 1 to 3 carbon atoms); m represents an integer from 1 to 3; Y represents an alkyl group (preferably an alkyl group having from 2 to 20 carbon atoms), a phenyl group, a vinyl group, an epoxy group, an acrylic group or a methacrylic group; m and n represent, each independently, an integer from 1 to 3; provided that m+n=4.

Examples of the silane coupling agent represented by Formula (4) include:

vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Among the foregoing an alkyltrialkoxysilane coupling agent represented by the following general Formula (5) is preferably used, from the viewpoint of imparting high hydrophobicity to the magnetic body.

$$C_pH_{2p+1}—Si—(OC_qH_{2q+1})_3 \quad (5)$$

Where, p represents an integer from 2 to 20, and q represents an integer from 1 to 3.

Sufficient hydrophobicity can be imparted to the magnetic body when p in Formula (5) is 2 or greater. Coalescing of magnetic bodies can be suppressed when p is 20 or smaller. Sufficient hydrophobicity can be imparted to the magnetic body, with good reactivity of the silane coupling agent, when q is 3 or smaller.

Preferably, p in Formula (5) is an integer from 3 to 15, and q is preferably 1 or 2.

In a case where a hydrophobic treatment agent such as a silane coupling agent is used, the treatment may be carried out using one type of agent alone, or may be carried out using two or more types concomitantly. When two or more types are used concomitantly, the treatment may be carried out using the hydrophobic treatment agents separately, or simultaneously.

The total treatment amount of the coupling agents that are used is preferably from 0.9 parts by mass to 3.0 parts by mass relative to 100 parts by mass of the magnetic body; the amount of the treatment agent can be adjusted for instance depending on the surface area of the magnetic body and the reactivity of the coupling agent.

Examples of colorants other than the magnetic body include the following.

Carbon black such as furnace black, channel black, acetylene black, thermal black and lamp black.

Pigments and dyes can be used as a yellow colorant. Examples of pigments include C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183 and 191, and C.I. Vat Yellow 1, 3 and 20. Examples of dyes include C.I. Solvent Yellow 19, 44, 77, 79, 81, 82, 93, 98, 103, 104, 112 and 162. The foregoing may be used as a single type, or alternatively two or more types may be used concomitantly.

Pigments and dyes can be used as a cyan colorant. Examples of pigment include C.I. Pigment Blue 1, 7, 15, 15; 1, 15; 2, 15; 3, 15; 4, 16, 17, 60, 62 and 66; C.I. Vat Blue 6; and C.I. Acid Blue 45. Examples of dyes include C.I. Solvent Blue 25, 36, 60, 70, 93 and 95. The foregoing may be used as a single type, or alternatively two or more types may be used concomitantly.

Pigments and dyes can be used as a magenta colorant. Examples of pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48; 2, 48; 3, 48; 4, 49, 50, 51, 52, 53, 54, 55, 57, 57; 1, 58, 60, 63, 64, 68, 81, 81; 1, 83, 87, 88, 89, 90, 112, 114, 122, 123, 144, 146, 150, 163, 166, 169, 177, 184, 185, 202, 206, 207, 209, 220, 221, 238 and 254; and C.I. Pigment Violet 19; and C.I. Vat Red 1, 2, 10, 13, 15, 23, 29 and 35. Examples of dyes include oil-soluble dyes such as C.I. Solvent Red 1, 3, 8, 23, 24, 25, 27, 30, 49, 52, 58, 63, 81, 82, 83, 84, 100, 109, 111, 121 and 122; C.I. Disperse Red 9; C.I. Solvent Violet 8, 13, 14, 21 and 27; and basic dyes such as C.I. Basic Red 1, 2, 9, 12, 13, 14, 15, 17, 18, 22, 23, 24, 27, 29, 32, 34, 35, 36, 37, 38, 39 and 40; and C.I. Basic Violet 1, 3, 7, 10, 14, 15, 21, 25, 26, 27 and 28. The foregoing may be used as a single type, or alternatively two or more types may be used concomitantly.

Preferably, the content of the colorant other than the magnetic body in the toner particle is from 0.5 parts by mass to 20 parts by mass relative to 100 parts by mass of the binder resin in the toner particle.

The toner particle can be produced in accordance with a pulverization method, and can be produced also in accordance with a method that involves producing the toner particle in an aqueous medium, for instance a dispersion polymerization method, an association aggregation method, a dissolution suspension method and an emulsion aggregation method. However, a method that involves producing the toner particle in an aqueous medium is preferable herein from the viewpoint of shape control.

A toner particle production method by suspension polymerization method will be explained next as an example of a toner particle production method.

In the suspension polymerization method, firstly a colorant (and also a polymerization initiator, a crosslinking agent, a charge control agent, and other additives as needed) is uniformly dispersed in a polymerizable monomer that can form a binder resin, to thereby obtain a polymerizable monomer composition. Thereafter, the obtained polymerizable monomer composition is dispersed in a continuous phase (for instance an aqueous phase) containing a dispersion stabilizer, using an appropriate stirrer, to thereby form (granulate) particles of the polymerizable monomer composition that are then subjected to a polymerization reaction, using a polymerization initiator, to yield a toner particle.

The shapes of the toner particle (ordinarily referred to as "polymerized toner particle") produced in accordance with the suspension polymerization method are evened off to be substantially spherical, and accordingly a toner particle satisfying the necessary or suitable requirements of the present invention is readily obtained, while also measurements of toner strength by nanoindentation can be performed with high reproducibility.

Examples of polymerizable monomers include:

styrenic monomers such as styrene, o-methylstyrene, m-methylstyrene, p-methylstyrene, p-methoxystyrene and p-ethylstyrene;

acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate;

methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate;

as well as acrylonitrile, methacrylonitrile and acrylamide.

The polymerizable monomer may be used as a single type, or alternatively two or more types may be used concomitantly.

Among the above polymerizable monomers there are preferably used a styrenic monomer alone, or a styrenic monomer concomitantly with another polymerizable monomer such as an acrylic acid ester or methacrylic acid ester. That is because in that case the structure of the toner particle is controlled, and the developing characteristic and a durability of the toner are readily enhanced.

Preferably, in particular, a styrenic monomer and at least one from among an alkyl acrylate ester and an alkyl methacrylate ester is used as a main component. That is, the binder resin is preferably a styrene acrylic resin.

Preferably the polymerization initiator used for producing the toner particle in accordance with a suspension polymerization method has a half-life from 0.5 hours to 30 hours at the time of the polymerization reaction. Preferably, the polymerization initiator is used in an amount from 0.5 parts by mass to 20 parts by mass relative to 100 parts by mass of the polymerizable monomer. Thereby it becomes possible to obtain a polymer having a molecular weight maximum from 5000 to 50000, and to impart preferred strength and appropriate melt characteristics to the toner particle.

From the viewpoint of fixing performance and mechanical strength, the peak molecular weight (Mp(T)) of the binder resin is preferably from 10000 to 35000, and more preferably from 15000 to 30000.

Examples of the polymerization initiator include:

azo or diazo polymerization initiators such as 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl)peroxydicarbonate and di(sec-butyl)peroxydicarbonate.

Preferred among the foregoing is t-butyl peroxypivalate.

The polymerization initiator may be used as a single type, or alternatively two or more types may be used concomitantly.

A crosslinking agent may be used during production of the toner particle in accordance with a suspension polymerization method. The amount of crosslinking agent is preferably from 0.001 parts by mass to 15 parts by mass relative to 100 parts by mass of the polymerizable monomer.

Examples of the crosslinking agent include compounds having two or more polymerizable double bonds, for instance aromatic divinyl compounds such as divinylbenzene and divinylnaphthalene;

carboxylic acid esters having two double bonds, such as ethylene glycol diacrylate, ethylene glycol dimethacrylate and 1,3-butanediol dimethacrylate;

divinyl compounds such as divinylaniline, divinyl ether, divinyl sulfide and divinyl sulfone; and compounds having three or more vinyl groups.

The crosslinking agent may be used as a single type, or alternatively two or more types may be used concomitantly.

The polymerizable monomer composition preferably contains a polar resin. In order to produce a toner particle in an aqueous medium, in the suspension polymerization method a polar resin may incorporated to thereby allow forming a polar resin layer on the surface of the toner particle, and allow forming a toner particle having a core/shell structure.

The degree of freedom of design of the core and shell is thus increased by virtue of the fact that the toner particle has a core/shell structure. For instance, increasing the glass transition temperature of the shell allows readily suppressing degradation of the toner during repeated use, for instance in terms of the depth of the penetration of the external additive into the toner particle. By imparting a shielding effect to the shell, the composition of the shell is readily made uniform, and as a result the toner can be charged uniformly.

Examples of the polar resin include:

homopolymers of styrene and substituted products thereof, such as polystyrene and polyvinyltoluene;

styrenic copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene-maleate ester copolymers;

as well as polymethyl methacrylate, polybutyl methacrylate, polyvinyl acetate, polyethylene, polypropylene, polyvinyl butyral, silicone resins, polyester resins, styrene-polyester copolymers, polyacrylate-polyester copolymers, polymethacrylate-polyester copolymers, polyamide resins, epoxy resins, polyacrylic acid resins, terpene resins and phenolic resins.

These polar resins may be used as a single type, or alternatively two or more types may be used concomitantly.

For instance, functional groups such as amino groups, carboxy groups, hydroxy groups, sulfonic acid groups, glycidyl groups and nitrile groups may be introduced into the polymer of the polar resin.

Polyester resins are preferred among these polyester resins.

A saturated polyester resin and/or an unsaturated polyester resin can be used as the polyester resin.

A resin synthesized from an alcohol component and an acid component can be used as the polyester resin; examples of the alcohol component and the acid component are given below.

Examples of divalent alcohol components include:

ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives represented by Formula (A) below, hydrogenated products of the bisphenol derivative represented by Formula (A) below, diols represented by Formula (B) below, and hydrogenated products of the diol represented by Formula (B).

(A)

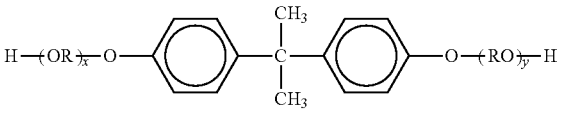

Where, R represents an ethylene group or a propylene group; and x and y are each independently an integer equal to or greater than 1, such that the average value of x+y is from 2 to 10.

(B)

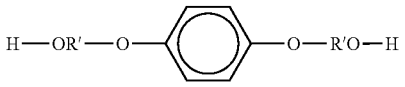

Where, R' represents —$CH_2CH_2$—,

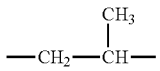

or

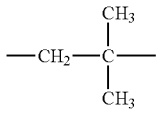

An alkylene oxide adduct is preferably used as the divalent alcohol component, given that such adducts exhibit superior charging characteristics and environment stability, balanced with other electrophotographic characteristics. In the case of an alkylene oxide adduct of bisphenol A, the average number of added moles of alkylene oxide lies preferably in the range from 2 to 10, from the viewpoint of fixing performance and toner durability.

Examples of divalent acid components include:

benzenedicarboxylic acids and anhydrides thereof, such as phthalic acid, terephthalic acid, isophthalic acid and phthalic anhydride;

alkyldicarboxylic acids and anhydrides thereof, such as succinic acid, adipic acid, sebacic acid and azelaic acid;

succinic acid substituted with an alkyl or alkenyl group having from 6 to 18 carbon atoms, as well as anhydrides thereof; and unsaturated dicarboxylic acids and anhydrides thereof, such as fumaric acid, maleic acid, citraconic acid and itaconic acid.

Examples of trihydric or higher alcohol components include glycerin, pentaerythritol, sorbitol, sorbitan and oxyalkylene ethers of novolac phenolic resins.

Examples of trivalent or higher acid components include trimellitic acid, pyromellitic acid, 1,2,3,4-butanetetracarboxylic acid, benzophenonetetracarboxylic acid, as well as anhydrides thereof.

The polyester resin is preferably a polycondensate of an alcohol component and a carboxylic acid component containing from 10 mol % to 50 mol % of a linear aliphatic dicarboxylic acid having from 6 to 12 carbon atoms relative to the total of carboxylic acid. As a result, the softening point of the polyester resin can be lowered readily, in a state where the peak molecular weight of the polyester resin has been raised. Thereby, the strength of toner is increased while maintaining a good fixing performance.

Preferably, from 45 mol % to 55 mol % of the polyester resin is an alcohol component, with respect to a total of 100 mol % of the alcohol component plus the acid component.

The polyester resin can be produced using for instance a catalyst such as a tin-based catalyst, an antimony-based catalyst or a titanium-based catalyst. A titanium-based catalyst is preferably used among the foregoing.

The number average molecular weight of the polar resin lies preferably in the range from 2500 to 25000, from the viewpoint of developing performance, blocking resistance and durability. The number average molecular weight can be measured by GPC.

The acid value of the polar resin is preferably from 1.0 mgKOH/g to 15.0 mgKOH/g, and more preferably from 2.0 mgKOH/g to 10.0 mgKOH/g. A polar resin shell is readily formed uniformly through control of the acid value so as to lie in the above range.

The content of the polar resin in the toner particle is preferably from 2 parts by mass to 20 parts by mass relative to 100 parts by mass of the binder resin, from the viewpoint of sufficiently bringing out the effect of the shell.

Preferably, the aqueous medium in which the polymerizable monomer composition is dispersed contains a dispersion stabilizer.

Examples of the dispersion stabilizer include surfactants, organic dispersing agents and inorganic dispersing agents. Inorganic dispersing agents are preferred among the foregoing because the steric hindrance of inorganic dispersing agents affords dispersion stability, and hence the stability of the dispersing agent is lost less readily even when the reaction temperature is changed; also, inorganic dispersing agents can be washed off readily, and are not prone to adversely affect the toner.

Examples of inorganic dispersing agents include inorganic compounds, for instance phosphoric acid polyvalent metal salts such as tricalcium phosphate, magnesium phosphate, aluminum phosphate, zinc phosphate and hydroxyapatite;

carbonates such as calcium carbonate and magnesium carbonate;

inorganic salts such as calcium metasilicate, calcium sulfate and barium sulfate;

as well as calcium hydroxide, magnesium hydroxide and aluminum hydroxide.

Preferably, the inorganic dispersing agent is used in an amount from 0.2 parts by mass to 20 parts by mass relative to 100 parts by mass of the polymerizable monomer. The dispersion stabilizer may be used as a single type, or alternatively two or more types may be used concomitantly. Further, from 0.001 parts by mass to 0.1 parts by mass of a surfactant may be used concomitantly. In a case where an inorganic dispersing agent is used, the dispersing agent may be used as-is, or may be used through generation of particles of the inorganic dispersing agent in an aqueous medium because in that case a finer toner particle can be obtained.

In a case for instance where tricalcium phosphate is used as the inorganic dispersing agent, a water-insoluble calcium phosphate can be produced, and a finer dispersion can be obtained, by mixing an aqueous solution of sodium phosphate and an aqueous solution of calcium chloride under high-speed stirring. Although a water-soluble sodium chloride salt is generated herein as a byproduct, a water-soluble salt is preferably present in the aqueous medium because in that case dissolution of the polymerizable monomer in water is inhibited, and ultrafine particles of toner, derived from emulsion polymerization, are generated less readily.

Examples of the surfactant include:

sodium dodecylbenzene sulfate, sodium tetradecyl sulfate, sodium pentadecyl sulfate, sodium octyl sulfate, sodium oleate, sodium laurate, sodium stearate and potassium stearate.

In a step of polymerizing the polymerizable monomer, the polymerization temperature is preferably 40° C. or higher, and is more preferably from 50° C. to 90° C. When the polymerization is carried out within this temperature range, sufficient encapsulation is made possible through precipitation, by phase separation, of the release agent to be encapsulated in the toner particle.

A cooling step follows next in which the whole is cooled from a reaction temperature from about 50° C. to 90° C., to terminate the polymerization reaction step. Preferably, cooling is performed gradually so as to maintain an interdissolved state of the release agent and the binder resin.

Once polymerization of the polymerizable monomer is over, the obtained polymer particles are thereafter filtered, washed, and dried, to yield a toner particle. An external additive is caused to adhere to the surface of the toner particle, by mixing as described above, so that the toner of the present invention can be obtained as a result. Further, a classification step may be included in the production process, for cutting a coarse powder and a fine powder in the toner particles.

Preferably, besides the external additive A, also another External additive B having a different particle size (for instance a smaller particle size) is concomitantly used. Charging performance and flowability can be controlled readily through the use of external additives having dissimilar particle sizes. When using the external additive A concomitantly with a different external additive, it is preferable to use an External additive B having a number-average particle diameter (D1) smaller than 40 nm.

Inorganic fine particles such as silica fine particles, alumina fine particles, titania fine particles and complex oxide fine particles of the foregoing, as well as organic-inorganic composite fine particles, such as those described for the external additive A, may be used as the External additive B.

In addition to the external additive A (and the External additive B) there may be used, as another external additive, for instance a lubricant such as fluororesin fine particles, zinc stearate fine particles or polyvinylidene fluoride fine particles; and/or an abrasive such as cerium oxide fine particles, silicon carbide fine particles or strontium titanate fine particles.

A method for measuring the various physical properties pertaining to the present invention will be explained next.

<Method for Measuring the Feret Diameter (Maximum Diameter) (a) of an External Additive, Penetration Depth (b) of External Additive A, Protrusion Height (c) of External Additive A, and Index (b/(b+c)) of Penetration>

(1) Observation of Toner Cross Sections by TEM

A toner is dispersed in a visible-light curable resin (product name: Aronix LCR series D-800, by Toagosei Co. Ltd.), followed by curing through irradiation with-short wavelength light. The obtained cured product is cut out with an ultramicrotome equipped with a diamond knife, to produce a 250 nm flaky sample. Next, the cut sample is magnified at a magnification from 40,000× to 50,000× using a transmission electron microscope (product name: electron microscope JEM-2800, by JEOL Ltd.) (TEM-EDX), to obtain cross-sectional images of toner particles.

The toner to be observed is selected as follows.

First, the cross-sectional area of the toner particle is worked out from an image of the cross-section thereof, and the diameter of a circle having an area equal to the cross-sectional area (circle-equivalent diameter) is worked out. Only images of cross sections of toner particles having an absolute value no greater than 1.0 μm of the difference between the circle-equivalent diameter and the weight-average particle diameter (D4) of the toner are observed herein.

(2) Method for Calculating the Feret Diameter (Maximum Diameter) (a) of an External Additive, Penetration Depth (b) of External Additive A, Protrusion Height (c) of External Additive A, Index (b/(b+c)) of Penetration, and Length (l) of Line Segment Z There is developed a TEM image resulting from cutting out a 400 nm portion, in the inward direction of the toner particle, from the surface of the external additive A, such that the Feret diameter (maximum diameter) (a) of the external additive is from 60 nm to 200 nm, and then the image is processed in such a manner that the surface (outline) of the toner particle is a straight line, as illustrated in FIGS. 1A and 1B. An outline X described below is not meant to be a straight line.

The Feret diameter (maximum diameter) a (nm) of the external additive A, the penetration depth b (nm) of the external additive A and the protrusion height c (nm) of the external additive A are worked out thereafter.

Herein b/(b+c), which is an index pertaining to penetration of the external additive A, is obtained on the basis of the penetration depth b and the protrusion height c.

Then the length l (nm) of a line segment Z is worked out, the line segment Z being a line segment obtained through joining, by a straight line, of both ends of the outline X which is the outline of a portion of the external additive A in contact with the toner particle, in the outline of the external additive A.

The image processing software Image J (available at https://imagej.nih.gov/ij) is used for image processing. The analysis count is set to 100 particles of external additive A, the average values are taken as the respective values of a, b, c and l of each sample, and respective standard deviations of the foregoing are worked out.

<Method for Measuring the Adhesion Index of the External Additive A>

A degree of migration of the external additive A when the toner is brought into contact with the substrate is evaluated herein, as a method for deriving the adhesion state of the external additive A. A substrate in which a polycarbonate resin is used as a material of the surface layer of the substrate is utilized in the present invention as a substrate that simulates the surface layer of the photosensitive member. Specifically, firstly a bisphenol Z-type polycarbonate resin (product name: Iupilon Z-400, by Mitsubishi Engineering Plastics Corporation, viscosity-average molecular weight (Mv): 40000) is dissolved in toluene to a concentration adjusted to 10 mass %, to yield a coating solution.

This coating solution is applied on a 50 μm thick aluminum sheet, using a #50 Meyer rod, to form a coating film. The coating film is dried for 10 minutes at 100° C., to thereby produce a sheet having a layer (thickness: 10 μm) of a polycarbonate resin on the aluminum sheet. The sheet is held on a substrate holder. The substrate is a square having sides of about 3 mm.

Hereinafter, a measurement step will be described divided into a step of arranging the toner on a substrate, a step of removing the toner from the substrate, and a step of quantifying the amount of adhesion of the external additive A supplied to the substrate.

Step of Arranging Toner on the Substrate

The toner is incorporated into a porous soft material (hereafter expressed as "toner holder"), and the toner holder is brought into contact with the substrate. A sponge (product name: White wiper) by Marusan Industry Co., Ltd. is used as the toner holder.

The toner holder is fixed to the tip of a load meter that is in turn fixed to a stage which moves in a direction perpendicular to the contact surface of the substrate, so that the toner holder and the substrate can be in contact with each other while a load is measured. Contact between the toner holder and the substrate is accomplished by repeating five times a step that involves moving the stage, pressing the toner holder against the substrate until the load meter indicates 10 N, and thereafter separating the toner holder from the substrate.

Step of Removing the Toner from the Substrate

An elastomer-made suction port having an inner diameter of about 5 mm and connected to the tip of a nozzle of a cleaner is brought close to the substrate after contact with the toner holder, in such a manner that the suction port is perpendicular to the toner placement surface, and then the toner adhered to the substrate is removed. The toner is removed herein while visually checking the extent of residual toner. The distance between the end of the suction port and the substrate is set to 1 mm, the suction time to 3 seconds, and the suction pressure to 6 kPa.

Step of Quantifying the Amount of Adhesion of External Additive Supplied To the Substrate Observation with a scanning electron microscope and image measurement are used for numerically quantifying the amount and shape of the external additive A remaining on the substrate after removal of the toner.

First, platinum is sputtered on the substrate, after removal of the toner, under conditions of a current of 20 mA for 60 seconds, to obtain an observation sample.

In an observation by scanning electron microscopy, observation magnifications that allow observing the external additive A are arbitrarily selected. Observations are performed on S-4800 (product name) backscattered electron images, using a Hitachi ultra-high resolution field-emission scanning electron microscope (product name: S-4800 (by Hitachi High-Technologies Corporation), as a scanning electron microscope. The observation magnifications are set to 50000×, the acceleration voltage to 10 kV, and the working distance to 3 mm. Observations can be performed under these conditions by discriminating the particle size of the external additive A.

In the images obtained through observation, the external additive A appears with high brightness and the substrate with low brightness, and hence the amount of external additive A in the field of view can be quantified by binarization. The binarization conditions are properly selected depending on the observation device and the sputtering conditions. In the present invention the image analysis software Image J (available at https://imagej.nih.gov/ij/) is used for binarization. After binarization, only the external additive A corresponding to a Feret diameter a (nm) in the range from 60 nm to 200 nm is extracted.

In the software Image J, Area and Feret's Diameter are checked, In Set Measurement, and the Analyze Particle function is used, to enable thereby the above extraction. On the basis of the result obtained through the Analyze Particle function, only the surface area of external additive A corresponding to a Feret diameter a (nm) in the range from 60 nm to 200 nm is integrated, and the result is divided by the surface area of the entire observation field, to thereby obtain the area ratio of the external additive A within the observation field. The above measurement is performed for 100 binarized images, and the resulting average value is taken as the area ratio [A] (units:area %) of the external additive A on the substrate.

The coverage ratio [B] (units:area %) of the external additive A on the toner particle is calculated next.

The coverage ratio of the external additive A is measured relying on observation with a scanning electron microscope, and using image measurement. The same magnifications under which the external additive A is observed on the substrate are adopted herein as the observation magnifications under which the external additive A is observed in the observation by scanning electron microscopy. The above Hitachi ultra-high resolution field-emission scanning electron microscope S-4800 (product name) is used as the scanning electron microscope.

The imaging conditions are as follows.

(1) Sample Production

A conductive paste is thinly applied onto a sample stand (15 mm×6 mm aluminum sample stand), and toner is blown onto the paste. Air is further blown to remove excess toner from the sample stand, and thoroughly dry the toner. The sample stand is set in a sample holder, and the height of the sample stand is adjusted to 36 mm using a sample height gauge.

(2) Setting of S-4800 Observation Conditions

The coverage ratio [B] of the external additive A is calculated using images obtained through backscattered electron image observation in S-4800. The coverage ratio [B] of the external additive A can be measured with good precision because charge-up is less pronounced in backscattered electron images than in secondary electron images.

Liquid nitrogen is poured into an anti-contamination trap attached to the housing of S-4800, until overflow, and the whole is allowed to stand for 30 minutes. Then "PC-SEM" of S-4800 is operated, to perform flushing (to purify a FE chip as an electron source). An acceleration voltage display portion of the control panel on the screen is clicked, and the [Flushing] button is pressed, to open a flushing execution dialog. Flushing is executed after the flushing strength is confirmed to be 2. It is then checked that an emission current by flushing is from 20 μA to 40 μA. The sample holder is inserted into a sample chamber of the S-4800 housing. Then [Origin] is pressed on the control panel, to transfer the sample holder to the observation position.

The acceleration voltage display portion is clicked to open an HV setting dialog, and acceleration voltage is set to [0.8 kV] and emission current to [20 μA]. In a [Basic] tab of the operation panel, signal selection is set to [SE], [Upper (U)] and [+BSE] are selected as an SE detector, and [L.A. 100] is selected using the selection button to the right of [+BSE], to set a mode of observation on a backscattered electron image.

In the same [Basic] tab of the operation panel, the probe current of a condition block of an electro-optical system is set to [Normal], focus mode to [UHR], and WD to [3.0 mm]. The [ON] button of the acceleration voltage display portion on the control panel is pressed, to apply acceleration voltage.

(3) Focus Adjustment

The magnification indicator in the control panel is dragged to set magnifications to 5000 (5k) magnifications. The [COARSE] focus knob on the operation panel is turned, and the aperture alignment is adjusted once a certain focus is achieved throughout the field of view. Then, [Align] is clicked on the control panel, to display an alignment dialog, and [Beam] is selected. The STIGMA/ALIGNMENT knobs (X, Y) on the operation panel are turned, and the displayed beam is moved to the center of the concentric circle. Then [Aperture] is selected, and the STIGMA/ALIGNMENT knobs (X, Y) are turned one at a time, until image movement ceases or is minimal. The aperture dialog is closed, and focusing is performed using autofocus. This operation is then repeated twice to adjust focus.

In a state where the midpoint of maximum diameter is aligned with the center of the measurement screen, for the target toner, the magnification indicator in the control panel is dragged to set magnifications to 10000 (10k) magnifications. The [COARSE] focus knob on the operation panel is turned, and aperture alignment is adjusted once a certain focus is achieved. Then, [Align] is clicked on the control panel to display an alignment dialog, and [Beam] is selected. The STIGMA/ALIGNMENT knobs (X, Y) on the operation panel are turned, and the displayed beam is moved to the center of the concentric circle.

Then, [Aperture] is selected, and the STIGMA/ALIGNMENT knobs (X, Y) are turned one at a time until image movement ceases or is minimal. The aperture dialog is closed, and focusing is performed using autofocus. Thereafter, magnifications are set to 50000 (50 k) magnifications, focus is adjusted using the focus knob and STIGMA/ALIGNMENT knobs as described above, and focusing is performed once more using autofocus. This operation is repeated again to adjust focus. When the inclination angle of an observation surface is large, the measurement precision of coverage ratio is prone to decrease. To perform the analysis, therefore, an observation surface exhibiting as little inclination as possible is selected by choosing the observation surface so that the entirety thereof becomes focused simultaneously.

(4) Image Storage

Brightness is adjusted in an ABC mode, and 640×480 pixel photographs are captured and stored. The analysis described below is performed using these image files. One photograph is captured for each toner, to obtain images of at least 30 particles of toner.

The observed images are binarized using the image analysis software Image J (available at https://imagej.nih.gov/injection/). After binarization, only an external additive A corresponding to a Feret diameter a (nm) in the range from 60 nm to 200 nm is extracted, and the coverage ratio (units:area %) of the external additive A on the toner particle is worked out.

The above measurement is performed for 100 binarized images, and the average value of the coverage ratio (units: area %) of the external additive A is taken as the coverage ratio [B] of the external additive A.

The adhesion index of the external additive A is calculated using the area ratio [A] of the external additive A on the substrate and the coverage ratio [B] of the external additive.

$$\text{Adhesion index of external additive } A = \text{area ratio}[A] \text{ of external additive } A \text{ on substrate/coverage ratio } [B] \text{ of external additive } A \times 100$$

<Method for Measuring the Coverage Ratio of the External Additive A>

A value of the coverage ratio [B] (units:area %) of the external additive A on the toner particle in the above method for measuring the adhesion index of the external additive A is used herein as the coverage ratio of the surface of the toner particle by the external additive A.

<Method for Measuring the Number-Average Particle Diameter and Shape Factor SF-2 of an External Additive>

To calculate the number-average particle diameter and shape factor SF-2 of the external additive A and other external additives, the external additive is observed using a transmission electron microscope (product name: JEM-2800, by JEOL Ltd.), and in a field of view maximally magnified to 200,000 magnifications, the major axis, circumference and surface area of 100 primary particles of external additive are calculated using image processing software. The image processing software used herein is Image-Pro Plus 5.1J (product name) by Media Cybernetics.

The number-average particle diameter is the average value of the major axis of 100 primary particles of external additive.

The value of SF-2 is the average of values calculated for each of the 100 primary particles of the external additive, for instance in accordance with the expression below.

$$\text{SF-2} = (\text{Circumference of particle})^2/(\text{Surface area of particle}) \times 100/4_{\pi}$$

<Method for Measuring Toner Strength by Nanoindentation>

Toner strength by nanoindentation is measured using a measurement instrument relying on a nanoindentation method (product name: PICODENTER HM500 by Fischer Technology Inc). The software used is WIN-HCU (product name). The indenter used is a Vickers indenter (tip angle: 130°).

Figure 5:
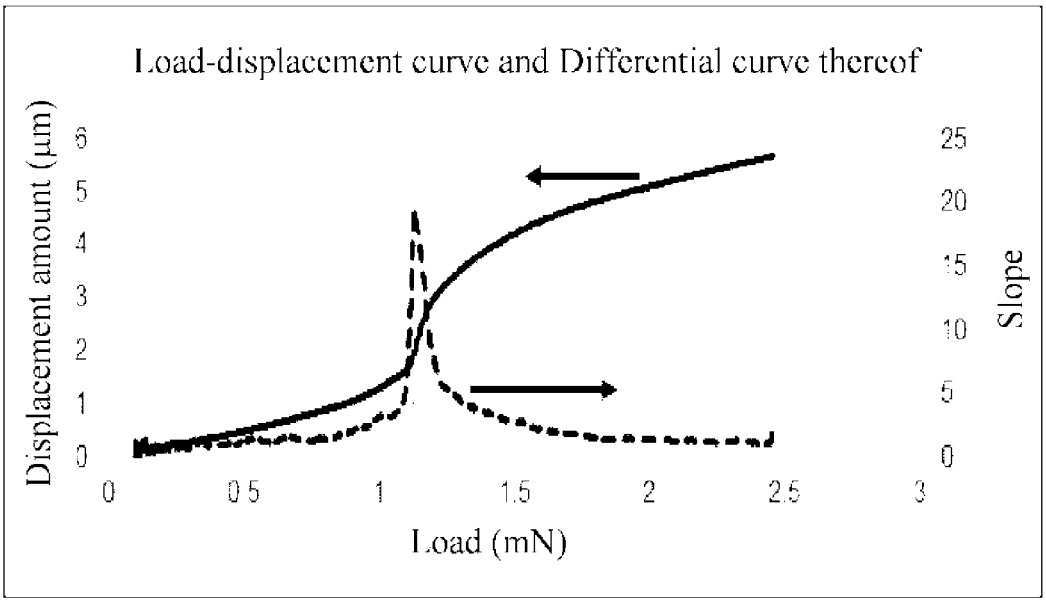
FIG. 5 is an example of a differential curve obtained through differentiation, by load, of a load-displacement curve obtained in accordance with a nanoindentation method.

The measurement includes mainly a step of pushing in the indenter at a prescribed rate until a predetermined load is reached (hereafter expressed as "indentation step"). Toner strength is calculated from the differential curve obtained through differentiation, by load, of a load-displacement curve obtained as a result of this indentation step, such as the one illustrated in FIG. 5.

Firstly the microscope is focused, with the video camera screen displayed on the software. The target for focusing is a glass plate (hardness=3600 N/mm$^2$) used for Z-axis alignment, described below. At this time, objective lenses are focused in sequence from 5× to 20× and 50×. Adjustment is carried out subsequently using the 50× objective lens.

The "Approach parameter setting" process is then carried out using the glass plate used for focusing as described above, to align the indenter in the Z-axis. The glass plate is then replaced by an acrylic plate and the "indenter cleaning" operation is carried out. The "indenter cleaning" operation is an operation in which the tip of the indenter is cleaned with a cotton swab moistened with ethanol, and the indenter position designated on the software is matched to the hardware indenter position, i.e., XY-axis alignment of the indenter is performed.

Changeover to a toner-adhered microscope slide is then performed, and the microscope is focused on the toner, as a measurement target. The toner is adhered to the microscope slide in accordance with the following procedure.

Firstly, the toner to be measured is caused to adhere to the tip of a cotton swab (by Johnson & Johnson K. K.), and excess toner is sifted out at, for example, the edge of a bottle. The rod of the cotton swab is then pressed against the edge of the microscope slide and the toner adhered to the cotton swab is tapped off so as to form a single layer of the toner on the microscope slide.

The microscope slide having the toner single layer adhered thereon as described above is set in the microscope; the toner is brought into focus with the 50× objective lens, and the tip of the indenter is positioned, with the help of software, so as to match the center of a toner particle. The selected toner particles are limited to particles for which both the major axis and minor axis are about D4 (μm) of the toner ±1.0 μm The measurement is performed by carrying out the indentation step under the following conditions (Indentation Step)

Maximum indentation load: 2.5 mN

Indentation time: 100 seconds

A load-displacement curve is constructed as a result of this measurement with load (mN) on the horizontal axis and displacement amount (μm) on the vertical axis.

As a method for calculating "the load at the largest slope", and which is defined as the toner strength, a load is taken at which a differential value in a differential curve resulting from differentiating a load-displacement curve by load takes on a maximum value. The load range for working out the differential curve is set to from 0.20 mN to 2.30 mN, with data precision in mind.

The above measurement is performed for 30 particles of toner, and the arithmetic average value of the results is used.

In the above measurement, the "indenter cleaning" operation (including also XY-axis alignment of the indenter) described above is always performed at each measurement of each single toner particle.

<Method for Measuring the Weight-Average Particle Diameter (D4)>

The weight-average particle diameter (D4) of the toner and toner particles is calculated by analyzing measurement data resulting from a measurement, in 25,000 effective measurement channels, using a precision particle size distribution measuring device (product name: Coulter Counter Multisizer 3, by Beckman Coulter, Inc.) relying on a pore electrical resistance method and equipped with a 100 μm aperture tube, and using dedicated software (product name: Beckman Coulter Multisizer 3, Version 3.51", by Beckman Coulter, Inc.) ancillary to the device, for setting measurement conditions and analyzing measurement data.

The aqueous electrolyte solution used in the measurements can be prepared through dissolution of special-grade sodium chloride to a concentration of about 1 mass % in ion-exchanged water; for instance ISOTON II (product name), manufactured by Beckman Coulter, Inc., can be used herein as the aqueous electrolyte solution.

The dedicated software is set up as follows, prior to measurement and analysis.

In the "Screen of Changing Standard Operating Mode (SOM)" of the dedicated software, a Total Count of the Control Mode is set to 50,000 particles, a Number of Runs is set to one, and a Kd value is set to a value obtained using "Standard particles 10.0 μm" (by Beckman Coulter). The "Threshold/Noise Level" measurement button is pressed to thereby automatically set a threshold value and a noise level. Then the current is set to 1600 μA, the gain is set to 2, the electrolyte solution is set to ISOTON II (product name), and flushing of the aperture tube following measurement is ticked.

In the "Screen for Setting Conversion from Pulses to Particle Size" of the dedicated software, the Bin Interval is set to a logarithmic particle diameter, the Particle Diameter Bin is set to 256 particle diameter bins, and the Particle Diameter Range is set to range from 2 μm to 60 μm.

Specific measurement methods are as described below.

(1) Herein about 200 mL of the aqueous electrolyte solution is placed in a 250 mL round-bottomed glass beaker ancillary to Multisizer 3. The beaker is set on a sample stand and is stirred counterclockwise with a stirrer rod at 24 revolutions per second. Dirt and air bubbles are then removed from the aperture tube by way of the "Aperture Flush" function of the dedicated software.

(2) Then, about 30 mL of the aqueous electrolyte solution is placed in a 100 mL flat-bottomed glass beaker. To the solution, about 0.3 mL of a dilution of "Contaminon N" (product name) by FUJIFILM Wako Pure Chemical Corporation, diluted thrice by mass in ion-exchanged water, is added as a dispersing agent. Contaminon N (product name) is a 10 mass % aqueous solution of a pH-7 neutral detergent for precision measuring instruments, made up of a nonionic surfactant, an anionic surfactant and organic builders.

(3) A predetermined amount of ion-exchanged water is placed in a water tank of an ultrasonic disperser (product name: Ultrasonic Dispersion System Tetora 150, by Nikkaki Bios Co., Ltd.), and about 2 mL of the above Contaminon N (product name) are added into the water tank. The Ultrasonic Dispersion System Tetora 150 is an ultrasonic disperser having an electrical output of 120 W and internally equipped with two oscillators that oscillate at a frequency of 50 kHz and are disposed at a phase offset of 180 degrees.

(4) The beaker in (2) is set in a beaker-securing hole of the ultrasonic disperser, which is then operated. The height position of the beaker is adjusted so as to maximize a resonance state at the liquid level of the aqueous electrolyte solution in the beaker.

(5) With the aqueous electrolyte solution in the beaker of (4) being ultrasonically irradiated, about 10 mg of the toner are then added little by little to the aqueous electrolyte solution, to be dispersed therein. The ultrasonic dispersion treatment is further continued for 60 seconds. The water temperature of the water tank during ultrasonic dispersion is adjusted as appropriate to lie in the range from 10° C. to 40° C.

(6) The aqueous electrolyte solution in (5) containing the dispersed toner is added dropwise, using a pipette, to the round-bottomed beaker of (1) set inside the sample stand, to adjust the measurement concentration to about 5%. A measurement is then performed until the number of measured particles reaches 50000.

(7) Measurement data is analyzed using the dedicated software ancillary to the apparatus, to calculate the weight-average particle diameter (D4). The "Average Size" in the "Analysis/Volume Statistics (arithmetic average)" screen, when Graph/% by Volume is selected in the dedicated software, yields herein the weight-average particle diameter (D4).

<Method for Measuring the Tg of the Toner Particle>

The Tg of the toner particle is measured according to ASTM D3418-82 using a differential scanning calorimeter (product name: Q2000, by TA Instruments Inc.). The temperature at the detection unit of the instrument is corrected on the basis of melting points of indium and zinc, and the amount of heat is corrected on the basis of heat of fusion of indium.

Specifically, 2 mg of sample are weighed exactly, and are placed on a pan made of aluminum; using an empty aluminum-made pan as a reference, a measurement is then carried out within a measurement temperature range from 30° C. to 200° C., at a ramp rate of 10° C./minute. In the measurement, the sample is heated once to 200° C., is next cooled down to 30° C., and thereafter is heated once more. A specific heat change is obtained within a temperature range from 40° C. to 100° C., in the course of this second heating. The intersection between a differential heat curve and a midpoint line of the baseline before and after the change in specific heat is taken herein as the glass transition temperature Tg.

<Method for Measuring the Acid Value of a Polyester Resin>

The acid value denotes the number of mg of potassium hydroxide necessary for neutralizing the acid contained in 1 g of sample. The acid value of amorphous polyester is measured in accordance with JIS K0070-1992, and specifically in accordance with the following procedure.

(1) Reagent Preparation

Herein 1.0 g of phenolphthalein is dissolved in 90 mL of ethyl alcohol (95 vol %), add ion exchanged water is added up to 100 mL, to yield a phenolphthalein solution.

Then 7 g of special-grade potassium hydroxide is dissolved in 5 mL of water, and ethyl alcohol (95 vol %) is added up to 1 L. In order to avoid contact with carbon dioxide and the like, the resulting solution is placed in an alkali-resistant container and is allowed to stand for 3 days, after which the solution is filtered, to yield a potassium hydroxide solution. The obtained potassium hydroxide solution is stored in an alkali-resistant container. Then 25 mL of 0.1 mol/L hydrochloric acid are placed in an Erlenmeyer flask, several drops of the phenolphthalein solution are added thereto, and titration is performed using the potassium hydroxide solution. The factor of the potassium hydroxide solution is then worked out from the amount of the potassium hydroxide solution required for neutralization. The 0.1 mol/L hydrochloric acid above is prepared in accordance with JIS K8001-1998.

(2) Operation (A) Main Test

Herein a 2.0 g sample of pulverized amorphous polyester is weighed exactly in a 200 mL Erlenmeyer flask, and 100 mL of a mixed solution of toluene/ethanol (2:1) is added, to dissolve the sample over 5 hours. Next, several drops of the phenolphthalein solution as an indicator are added, and titration is performed using the potassium hydroxide solution. The end point of the titration is the point in time at which the light red color of the indicator lasts for about 30 seconds.

(B) Blank Test

Titration is performed in accordance with the same operation as described above, but herein without using a sample (i.e. by using only the mixed solution of toluene/ethanol (2:1)).

(3) The acid value is calculated by substituting the obtained result into the following expression:

$$A=[(C-B)\times f\times 5.61]/S$$

In the expression, A is the acid value (mgKOH/g), B is the addition amount (mL) of potassium hydroxide solution in the blank test, C is the addition amount (mL) of potassium hydroxide solution in the main test, f is the factor of the potassium hydroxide solution, and S is the mass (g) of the sample.

EXAMPLES

The present invention will be described more specifically hereafter by way of examples. In the formulations below all parts are parts by mass, unless otherwise specified.

Production Examples of External Additives A-1 to A-8

External additives A-1 to A-8 which are organic-inorganic composite fine particles were produced according to the examples described in WO 2013/063291.

The physical properties of External additives A-1 to A-8 are given in Table 1.

Production Examples of External Additives A-9 and A-10

A mixed gas of silicon tetrachloride, oxygen, and hydrogen was introduced into a burner, and was fired at a burner temperature of 1100° C., was cooled down, and was trapped in a bag filter. The obtained fumed silica fine particles were dispersed in the gas phase, and then 6 parts of hexamethyldisilazane as a surface treatment agent were sprayed on 100 parts of the fumed silica fine particles; the reaction was let to proceed while under stirring, so as to preclude the fumed silica particles from coalescing.

The obtained reaction product was dried, and thereafter was subjected to a heating treatment at 130° C. for 2 hours, and was adjusted to 123 nm and 78 nm by classification, to yield External additives A-9 and A-10 which are silica particles.

The physical properties of External additives A-9 and A-10 are given in Table 1.

Production Example of External Additive A-11

After supply of oxygen gas to an ignition burner and igniting of the burner, hydrogen gas was supplied to the burner, for flame formation, and silicon tetrachloride as a starting material was added, to elicit gasification. A flame hydrolysis reaction was conducted under the conditions of a silicon tetrachloride amount of 100 kg/hour, an oxygen gas amount of 30 $Nm^3$/hour, a hydrogen gas amount of 50 $Nm^3$/hour and a residence time of 0.01 seconds, and the generated silica powder was recovered.

The obtained silica powder was transferred to an electric furnace, was spread as a thin layer, and was subjected to a heating treatment at 750° C., to elicit sintering and aggregation, and yield silica fine particles.

A hydrophobic treatment was performed through addition of 10 parts of hexamethyldisilazane, as a surface treatment agent, to 100 parts of the obtained silica fine particles, followed by adjustment to 185 nm through classification, to yield External additive A-11 which was silica particles.

The physical properties of External additive A-11 are given in Table 1.

Production Examples of External Additives A-12 and A-13, and External Additive-14 and External Additive-15

Herein 687.9 g of methanol, 42.0 g of pure water and 47.1 g of 28 mass % of ammonia water were placed and mixed in a 3 L glass reactor equipped with a stirrer, a dropping funnel and a thermometer. The temperature of the obtained solution was adjusted to 35° C., and addition of 1100.0 g (7.23 mol) of tetramethoxysilane and 395.2 g of 5.4% by mass of ammonia water was simultaneously started, while under stirring. The tetramethoxysilane was added dropwise over 5 hours, while the ammonia water was added dropwise over 4 hours.

Once dropwise addition was complete, stirring was thereafter further continued for 0.2 hours to elicit hydrolysis, and obtain as a result a methanol-water dispersion of hydrophilic spherical sol-gel silica fine particles.

Subsequently, an ester adapter and a cooling tube were mounted on the glass reactor, and the dispersion was heated at 65° C. to distill methanol off. Thereafter, pure water was added to the residue in the same amount as that of the distilled-off methanol. This dispersion was thoroughly dried under reduced pressure, at 80° C. The obtained silica particles were heated at 400° C. for 10 minutes in a thermostat bath. The foregoing process was carried out 20 times, and the obtained silica fine particles (untreated silica) were subjected to a deagglomeration treatment using a pulverizer (by Hosokawa Micron Group).

Thereafter, 500 g of the silica particles were charged into a polytetrafluoroethylene inner cylinder-type stainless autoclave having an inner volume of 1000 mL. The interior of the autoclave was replaced with nitrogen gas, and thereafter 0.5 g of hexamethyldisilazane and 0.1 g of water were nebulized in a two-fluid nozzle and uniformly sprayed onto the silica particles while a stirring blade attached to the autoclave was caused to rotate at 400 rpm. After stirring for 30 minutes, the autoclave was sealed and heated at 200° C. for 2 hours. Subsequently, the pressure in the system was reduced, while still under heating, to elicit deammoniation, and yield External additive A-12 which was silica particles.

The physical properties of External additive A-12 are given in Table 1.

External additive A-13, External additive-14 and External additive-15 were obtained in the same way as External additive A-12, but modifying herein the particle size of the untreated silica that was used, and adjusting the intensity of the deagglomeration treatment.

The physical properties of External additive A-13, External additive-14 and External additive-15 are given in Table 1.

Production Example of External Additive B-1

Base material silica (fumed silica particle having a number-average particle diameter of primary particles of 12 nm) was charged into an autoclave equipped with a stirrer, and the whole was heated at 200° C. in a fluidized state elicited by stirring.

The interior of the reactor was replaced with nitrogen gas, the reactor was sealed, 25 parts of hexamethyldisilazane were sprayed into the reactor, relative to 100 parts of the base material silica, and a silane compound treatment was carried out, with the silica in a fluidized state. This reaction was continued for 60 minutes, after which the reaction was terminated. Once the reaction was terminated, the autoclave was depressurized, and was washed with a nitrogen gas stream, to remove excess hexamethyldisilazane and by-products from the obtained hydrophobic silica.

Then 10 parts of dimethyl silicone oil (viscosity: 100 $mm^2/s$) was sprayed on 100 parts of the base material silica, while under stirring of the hydrophobic silica inside the reaction vessel, and stirring was continued for 30 minutes. Thereafter stirring was further performed for 2 hours as the temperature was raised to 300° C. while under stirring. The resulting product was retrieved, and was subjected to a deagglomeration treatment, to yield External additive B-1 which was silica particles.

<Synthesis of Polyester Resins>

The components given below were placed in a reactor equipped with a cooling tube, a stirrer and a nitrogen inlet tube, and were caused to react at 230° C. for 10 hours while water generated under the current of nitrogen gas was distilled off.

| | |
|---|---|
| Bisphenol A ethylene oxide 2-mol adduct | 350 parts |
| Bisphenol A propylene oxide 2-mol adduct | 326 parts |
| Terephthalic acid | 250 parts |
| Titanium-based catalyst (titanium dihydroxybis(triethanolaminate)) | 2 parts |

Next, the reaction was conducted under reduced pressure from 5 to 20 mmHg, and when the acid value became 0.1 mg KOH/g or lower, the reaction product was cooled to 180° C., and 80 parts of trimellitic anhydride were added. After 2 hours of reaction at normal pressure under sealed conditions, the reaction product was retrieved, cooled to room temperature, and then pulverized to obtain a polyester resin. The acid value of the obtained resin was 8 mgKOH/g.

Production Example of a Treated Magnetic Body

In an aqueous solution of ferrous sulfate, from 1.00 to 1.10 equivalents of a sodium hydroxide solution, relative to iron atoms, $P_2O_5$ in an amount of 0.15 mass % on phosphorus atom basis relative to iron atoms, and $SiO_2$ in an amount of 0.50 mass % on silicon atom basis relative to iron atoms were mixed. Thereafter, an aqueous solution containing ferrous hydroxide was prepared. The pH of this aqueous solution was adjusted to 8.0, and an oxidation reaction was carried out at 85° C. while air was blown in, to prepare a slurry liquid having seed crystals.

Next, an aqueous solution of ferrous sulfate was added to the slurry liquid, in an amount from 0.90 to 1.20 equivalents relative to the initial alkali amount (sodium component of sodium hydroxide). Thereafter, the slurry liquid was maintained at pH 7.6, and an oxidation reaction was let to proceed while air was blown in, to prepare a slurry liquid containing a magnetic iron oxide.

The obtained slurry liquid was filtered, was washed, and thereafter the water-containing slurry was retrieved temporarily. At this time a small amount of the water-containing slurry was sampled, and the water content was measured.

Next, this water-containing slurry was placed in another aqueous medium, without drying, and was re-dispersed in a pin mill, while the slurry was stirred and caused to circulate, and the pH of the re-dispersed solution was adjusted to about 4.8.

Then 1.6 parts of a n-hexyltrimethoxysilane coupling agent were added, while under stirring, to 100 parts of magnetic iron oxide (the amount of magnetic iron oxide was calculated by subtracting the water content from the water-containing slurry) to elicit hydrolysis. This was followed by a surface treatment through stirring, and with the pH of the dispersion set to 8.6. The generated hydrophobic magnetic body was filtered using a filter press, was washed with a large amount of water, was then dried for 15 minutes at 100° C., and was then dried at 90° C. for 30 minutes. Thereafter, the obtained particles were subjected to a deagglomeration treatment, to yield a treated magnetic body having a volume-average particle diameter of 0.21 μm.

Production Example of Toner Particle T-1

Herein, 450 parts of a 0.1 mol/L $Na_3PO_4$ aqueous solution were added to 720 parts of ion-exchanged water, with warming at 60° C., followed by addition of 67.7 parts of a 1.0 mol/L $CaCl_2$ aqueous solution, to yield an aqueous medium containing a dispersing agent.

| | |
|---|---|
| Styrene | 75.0 parts |
| n-Butyl acrylate | 25.0 parts |
| Polyester resin | 10.0 parts |
| Divinylbenzene | 0.6 parts |
| Iron complex of monoazo dye (product name: T-77, by Hodogaya Chemical Co., Ltd.) | 1.5 parts |
| Treated magnetic body | 65.0 parts |

The above materials were dispersed and mixed uniformly using an attritor (by Miike Chemical Engineering Machinery Co., Ltd.), to yield a polymerizable monomer composition. This polymerizable monomer composition was warmed at 63° C., and then 15.0 parts of paraffin wax (melting point 78° C.) were added, and dissolved in the composition through mixing therewith. Thereafter 7.0 parts of the polymerization initiator tert-butylperoxypivalate were dissolved.

The polymerizable monomer composition was charged into the above aqueous medium, and the whole was stirred for 10 minutes at 12000 rpm using a TK-type homomixer (by Tokushu Kika Kogyo Co., Ltd.), in a nitrogen atmosphere at 60° C., to form particles (elicit granulation).

Thereafter, the reaction was conducted for 4 hours at 70° C., while under stirring using a paddle stirring blade. After the reaction was over, colored resin particles were dispersed in the obtained aqueous medium, and it was confirmed that calcium phosphate as an inorganic dispersing agent was adhered to the surface of the colored resin particles.

Next, the aqueous medium having the colored resin particles dispersed therein was warmed up to 100° C., and that temperature was held for 120 minutes. This was followed by cooling down to room temperature at 3° C./minute, whereupon hydrochloric acid was added to dissolve the dispersing agent, and the whole was filtered, was washed with water, and was dried, to yield Toner particle T-1 having a weight-average particle diameter (D4) of 8.0 μm.

The physical properties of the obtained Toner particle T-1 are given in Table 2.

Production Examples of Toner Particles T-2 to T-5

Toner particles T-2 to T-5 were produced in the same way as in the production example of Toner particle T-1, but herein the addition amount of polymerization initiator in the production of Toner particle 1 was modified as set out in Table 2.

The physical properties of the obtained Toner particles T-2 to T-5 are given in Table 2.

Production Example of Toner Particle T-6

Herein 715 parts of ion-exchanged water and 750 parts of a 0.1 mol/L $Na_3PO_4$ aqueous solution were added into a four-necked container, which was held at 60° C. while under stirring at 12000 rpm using a high-speed stirring device T.K. Homomixer (by Tokushu Kika Kogyo Co., Ltd.). Then 68 parts of a 1.0 mol/L $CaCl_2$ aqueous solution were added gradually, to prepare a fine poorly water-soluble dispersion stabilizer $Ca_3(PO_4)_2$.

| | |
|---|---|
| Styrene | 125 parts |
| n-Butyl acrylate | 35 parts |
| Copper phthalocyanine pigment (Pigment blue 15: 3) | 15 parts |

Polyester resin (condensation polymer of terephthalic acid and propylene oxide 2-mole adduct of bisphenol A (terephthalic acid: propylene oxide 2-mole adduct of bisphenol A=51:50 (molar ratio)), acid value: 10 mgKOH/g, glass transition temperature: 70° C., Mw: 10500, Mw/Mn: 3.30) 10 parts

| | |
|---|---|
| Negative charge control agent (aluminum compound of 3,5-di-tert-butylsalicylic acid) | 0.9 parts |
| Wax (Fischer-Tropsch wax, endothermic main peak temperature: 78° C.) | 13 parts |

The above materials were stirred for 3 hours using an attritor (by Nippon Coke & Engineering Co., Ltd.), to disperse the components in the polymerizable monomers, and prepare a monomer mixture. Then, 20.0 parts of the polymerization initiator 1,1,3,3-tetramethylbutylperoxy-2-ethylhexanoate (50 mass % toluene solution) were added to the monomer mixture, to prepare a polymerizable monomer composition.

The polymerizable monomer composition was placed in an aqueous dispersion medium and was granulated for 5 minutes while maintaining the revolution speed of the stirrer at 10000 rpm. Thereafter, the high-speed stirring device was changed to a propeller stirrer, internal temperature was raised to 70° C., and the reaction was conducted for 6 hours while under slow stirring.

Next, the temperature inside the container was raised to 80° C. and was maintained for 4 hours, followed by gradual cooling down to 30° C. at a cooling rate of 1° C. per minute, to yield a slurry. Dilute hydrochloric acid was added to the container containing the slurry, to remove the dispersion stabilizer. The slurry was then filtered, washed and dried, to yield Toner particle T-6 having a weight-average particle diameter (D4) of 8.0 μm.

The physical properties of the obtained Toner particle T-6 are given in Table 2.

Production Example of Toner Particle T-7

(Preparation of dispersions)

[Resin particle dispersion (1)]

| | |
|---|---|
| Styrene (by FUJIFILM Wako Pure Chemical Corporation) | 325 parts |
| n-Butyl acrylate (by FUJIFILM Wako Pure Chemical Corporation) | 100 parts |
| Acrylic acid (by Rhodia Nicca, Ltd.) | 13 parts |
| 1,10-Decanediol diacrylate (by Shin-Nakamura Chemical Co., Ltd.) | 1.5 parts |
| Dodecanethiol (by FUJIFILM Wako Pure Chemical Corporation) | 3 parts |

These materials were mixed beforehand and dissolved to prepare a solution; then a surfactant solution of 9 parts of an anionic surfactant (product name: Dowfax A211, by The Dow Chemical Company) dissolved in 580 parts of ion-exchanged water was placed in a flask. Then 400 parts of the above solution were introduced, with dispersion and emulsification, and 6 parts of ammonium persulfate dissolved in 50 parts ion-exchanged water were introduced while under slow stirring and mixing for 10 minutes.

Then, after the interior of the flask had been thoroughly replaced with nitrogen, the interior of the flask was heated to 75° C. on an oil bath, while under stirring, and emulsion polymerization was continued in this state for 5 hours, to obtain a resin particle dispersion (1).

The resin particles were separated from the resin particle dispersion (1) and the properties of the particles were checked. It was found that the number-average particle diameter was 195 nm, the solids fraction in the dispersion was 42%, the glass transition temperature was 51.5° C., and the weight-average molecular weight (Mw) was 32,000.

[Resin Particle Dispersion (2)]

The amorphous polyester was dispersed using a disperser obtained by modifying Cavitron CD1010 (by Eurotec, Ltd.) to a high-temperature high-pressure model. Specifically, firstly 79 mass % of ion-exchanged water, 1 mass % (effective component) of a surfactant (DKS Co., Ltd.: Neogen RK), and 20 mass % of the above amorphous polyester had pH adjusted to 8.5 using ammonia. Then Cavitron was operated under conditions of rotor revolution speed of 60

Hz, pressure of 5 kg/cm$^2$, and heating to 140° C. using a heat exchanger. A resin fine particle dispersion (2) having a number-average particle diameter of 200 nm was obtained.

[Colorant-Dispersed Solution]

| | |
|---|---|
| Carbon black | 20 parts |
| Anionic surfactant (product name: Neogen R, by DKS Co., Ltd.) | 2 parts |
| Ion-exchanged water | 78 parts |

Using a homogenizer (product name: Ultra-Turrax T50, by IKA K.K.), with the above materials, the pigment was mixed with water for 2 minutes at 3000 rpm, and was further dispersed for 10 minutes at 5000 rpm, followed by defoaming through stirring for one day and night using an ordinary stirrer. Thereafter, the whole was dispersed for approximately 1 hour at a pressure of 240 MPa using a high-pressure impact-type disperser Ultimizer (product name: HJP30006, by Sugino Machine Limited), to yield a colorant-dispersed solution. The pH of this dispersion was adjusted to 6.5.

[Release Agent Dispersion]

Hydrocarbon wax (Fischer-Tropsch wax, peak temperature at maximum endothermic peak:

| | |
|---|---|
| 78° C., weight-average molecular weight: 750) | 45 parts |
| Anionic surfactant (product name: Neogen RK, by DKS Co., Ltd.)) | 5 parts |
| Ion-exchanged water | 200 parts |

These materials were heated to 95° C. and were dispersed using a homogenizer (Ultra-Turrax T50, by IKA K.K.). This was followed by dispersion using a high-pressure ejection-type Gaulin homogenizer, to yield a release agent dispersion having a number-average particle diameter of 190 nm and a solids fraction of 25%.

[Toner Particle Production Example]

| | |
|---|---|
| Ion-exchanged water | 400 parts |
| Resin particle dispersion (1) (resin particle concentration: 42 mass %) | 620 parts |
| Resin particle dispersion (2) (resin particle concentration: 20 mass %) | 279 parts |
| Anionic surfactant (product name: Neogen RK, manufactured by DKS Co., Ltd.; effective component proportion: 60 mass %) | 1.5 parts (0.9 parts as effective component). |

The above materials were introduced into a 3 L reactor equipped with thermometer, pH meter, and stirrer and, while externally controlling the temperature with a mantle heater, and the system was held for 30 minutes at a temperature of 30° C. and a stirring revolution speed of 150 rpm.

Thereafter, 88 parts of a colorant dispersion and 60 parts of a release agent dispersion were inputted, with holding for 5 minutes. With the system in this state, pH was then adjusted to 3.0 through addition of a 1.0% aqueous solution of nitric acid.

The stirrer and mantle heater were then removed. One half of a mixed solution of 0.33 parts of polyaluminum chloride and 37.5 parts of a 0.1% aqueous solution of nitric acid was added, while under dispersing at 3,000 rpm using a homogenizer (Ultra-Turrax T50, by IKA Japan). The dispersion revolution speed was thereafter raised to 5,000 rpm, the remaining half was added over 1 minute, and the dispersion revolution speed was raised to 6,500 rpm, and dispersion was carried out for 6 minutes.

The stirrer and mantle heater were mounted on the reactor and, while adjusting the revolution speed of the stirrer as appropriate so as to thoroughly stir the slurry, the slurry was heated up to 42° C. at a rate of 0.5° C./minute. Thereafter the particle diameter was measured every 10 minutes, using a Coulter Multisizer, while raising the temperature at 0.05° C./minute. When the weight-average particle diameter had reached 7.8 μm, the pH was brought to 9.0 using a 5% aqueous solution of sodium hydroxide.

Thereafter, while adjusting the pH to 9.0 every 5° C., the temperature was raised to 96° C. at a ramp rate of 1° C./minute and that state at 96° C. was held for 3 hours. This was followed by cooling to 20° C. at 1° C./minute, to elicit particle solidification.

The reaction product was thereafter filtered and washed by throughflow of ion-exchanged water. When the conductivity of the filtrate dropped to 50 mS or less, the resulting particle cake was retrieved and was introduced into ion-exchanged water in an amount of 10 times the particle mass. The particles were thoroughly dispersed through stirring using a Three-One motor, and the pH was adjusted to 3.8 with a 1.0% aqueous solution of nitric acid, whereupon the whole was held for 10 minutes.

This was followed by another filtration once again, and washing by water throughflow. When the conductivity of the filtrate dropped to 10 mS or less, the water throughflow was discontinued and solid-liquid separation was carried out.

The obtained particle cake was deagglomerated using a sample mill and was dried for 24 hours in an oven at 40° C. The obtained particles were deagglomerated using a sample mill and were thereafter additionally vacuum-dried for 5 hours in a oven at 40° C. to obtain Toner particle T-7.

The physical properties of the obtained Toner particle T-7 are given in Table 2.

Production Example of Toner Particle T-8

(Production Example of a High-Molecular Weight Component)

| | |
|---|---|
| Styrene | 75.3 parts |
| n-Butyl acrylate | 20.0 parts |
| Monobutyl maleate | 4.7 parts |
| Divinylbenzene | 0.008 parts |
| 2,2-bis (4,4-di-t-butylperoxycyclohexyl)propane | 0.150 parts |

Herein 200 parts of xylene were stirred in a four-necked flask, the interior of the flask was replaced with nitrogen, and temperature was raised to 120° C., after which the above components were added dropwise over 4 hours. Polymerization was completed under reflux of xylene, and the solvent was distilled off under reduced pressure. The resin thus obtained was used as a high-molecular weight component.

(Production Example of a Low-Molecular Weight Component)

| | |
|---|---|
| Styrene | 69.5 parts |
| n-Butyl acrylate | 22.0 parts |
| Monobutyl maleate | 8.5 parts |
| Di-t-butyl peroxide | 1.1 parts |

The above materials were added dropwise over 4 hours onto 200 parts of xylene. Polymerization was completed under reflux of xylene, and the solvent was distilled off under reduced pressure. The resin thus obtained was used as a low-molecular weight component.

The high-molecular weight component and low-molecular weight component thus obtained are mixed and dissolved at a ratio of 20 parts/80 parts of high-molecular weight component/low-molecular weight component, with respect to 200 parts of xylene. After raising of the temperature and stirring and mixing for 12 hours under reflux, the organic solvent was distilled off, and the obtained resin was cold-rolled, solidified, and thereafter pulverized, to yield a styrene acrylic resin.

Styrene acrylic resin 1 100 parts

Magnetic iron oxide particles (average particle size: 0.13 m, Hc=11.5 kA/m, $\sigma s$=88 $Am^2/kg$, $\sigma r$=14 $Am^2/kg$) 60 parts Fischer-Tropsch wax (product name: C105, by Sasol Limited, melting point: 105° C.) 2 parts Charge control agent (product name: T-77, by Hodogaya Chemical Co., Ltd.) 2 parts The above materials were pre-mixed using a Henschel mixer, and were then melt-kneaded using a twin-screw kneading extruder (product name: PCM-30, by Ikegai Corp.), with the temperature set so that the temperature of the melt product at a discharge port was 150° C.

The obtained kneaded product was cooled, and was coarsely pulverized using a hammer mill, followed by fine pulverization using a crusher (product name: T-250, by Turbo Kogyo Co., Ltd.). The obtained finely pulverized powder was classified using a multi-grade classifier relying on the Coanda effect, to yield Toner particle T-8 having a weight-average particle diameter (D4) of 7.8 μm.

The physical properties of the obtained Toner particle T-8 are given in Table 2.

Production Example of Toner 1

Herein 100 parts of Toner particle T-1, 1.5 parts of External additive A-1 and 0.3 parts of External additive B-1 were mixed for 100 seconds at a peripheral velocity of 35 m/s, using a Mitsui Henschel mixer (FM) (by Mitsui Miike Kakoki K. K.) (first time). Thereafter, a warming treatment was carried out using the mixing processor illustrated in FIG. 2 (second time).

An apparatus having an inner periphery diameter of the body casing 310 of 130 mm was used as the mixing processor illustrated in FIG. 2, and the configuration conditions of the mixing processor were set to those given in Table 3-1. Warm water was caused to flow through the interior of the jacket, so that the temperature (T1) inside the starting material inlet inner piece 316 was 55° C.

Toner having undergone the above external addition was charged into the mixing processor illustrated in FIG. 2 and having the configuration above, and thereafter was thermally treated for 10 minutes while the peripheral velocity (1.0 m/s) of the outermost end of the stirring member blades 33 was adjusted so as to be constant at the effective operation power given in Table 3-1.

Once the heating treatment was over, Toner 1 was thereafter obtained through sifting using a mesh having a mesh opening of 75 μm.

The physical properties of Toner 1 are set out in Table 3-1.

Production Examples of Toners 2 to 16

Toners 2 to 16 were obtained in the same way as in production example of Toner 1, but herein the materials and production conditions of the production example of Toner 1 were modified to those given in Table 3-1 and Table 3-2.

The physical properties of Toners 2 to 16 are set out in Table 3-1 and Table 3-2.

Production Examples of Toners 17 and 20

Toners 17 and 20 were obtained by modifying the production example of Toner 1 to the materials given in Table 3-2, and with mixing using a Mitsui Henschel mixer (FM) (by Mitsui Miike Kakoki K. K.), for 10 minutes at a peripheral velocity of 46 m/s.

The physical properties of Toners 17 and 20 are given in Table 3-2.

Production Examples of Toners 18 and 19

Toners 18 and 19 were obtained by modifying the production example of Toner 1 to the materials given in Table 3-2, and with mixing using a Mitsui Henschel mixer (FM) (by Miike Chemical Engineering Machinery Co., Ltd.), for 10 minutes at a peripheral velocity of 46 m/s.

The obtained Feret diameters (maximum diameter) of External additives 14 and 15 in Toner 18 and Toner 19 were 50 nm for Toner 18, and 220 nm for Toner 19. Toner 18 and Toner 19 did not contain an external additive corresponding to external additive A.

Production Example of Toner 21

Toner 21 was obtained in the same way as in production example of Toner 1, but herein the materials and production conditions of the production example of Toner 1 were modified to those given in Table 3-2.

The physical properties of Toner 21 are set out in Table 3-2.

Example 1

Herein 150 g of Toner 1 were filled into a cartridge (product name: CF230X) for a laser printer (product name: LaserJet Prom203dw, by The Hewlett-Packard Company) of an electrophotographic system that utilized a cleaner-less system.

<Transfer Efficiency of Line Images>

In a low-temperature and low-humidity environment (15° C./10% RH), transfer current was adjusted to 5.0 μA, and a horizontal line image of 4 dots/4 spaces was outputted. Untransferred toner on the surface of the photosensitive member was stripped off after a transparent polyester adhesive tape that had been affixed to the photosensitive member (product name: polyester tape No. 5511, manufactured by Nichiban Co., Ltd.). The density of the adhesive tape alone affixed to paper was subtracted from the density of the stripped tape affixed to paper, to calculate a respective density difference.

Evaluation timings of transfer efficiency of the horizontal line image were set to the point in time of output of one image, the point in time of output of 3500 prints of the image, and the point in time of output of 5000 prints image. The horizontal line image was outputted in an intermittent mode, with a temporary pause every two prints of horizontal lines such that the print percentage was 1%.

The measurement of density was carried out using Reflectometer Model TC-6DS by Tokyo Denshoku Co., Ltd.). A green filter was used as a filter in the measurements.

The evaluation criteria are set out below. The results are given in Table 4-1.

A: Density difference smaller than 5.0

B: Density difference from 5.0 to less than 10.0.

C: Density difference from 10.0 to less than 15.0.

D: Density difference of 15.0 or greater.

The smaller the value of density difference, the better is the result denoted thereby.

<Evaluation of Scattering>

To evaluate scattering, line reproducibility and toner scattering around lines upon printout of a 1-dot line image, which is prone to exhibit scattering, was evaluated visually in a low-temperature and low-humidity environment (15.0° C., 10.0% RH). The evaluation timings were identical to those of the evaluation of transfer efficiency.

The evaluation criteria are set out below. The results are given in Table 4-1.

A: virtually no scattering occurred; good line reproducibility.

B: slight scattering visible.

C: scattering visible, but with little impact on line reproducibility.

D: pronounced scattering visible; poor line reproducibility.

<Image Density>

To measure image density, a full solid black image was formed in a high-temperature, high-humidity environment (32.5° C./80% RH), and the density of this solid image was measured using a MacBeth densitometer (MacBeth Corporation) with an SPI filter. The evaluation timings were identical to those of the evaluation of transfer efficiency.

The evaluation criteria are set out below. The results are given in Table 4-1.

A: 1.45 or greater

B: from 1.40 to less than 1.45

C: from 1.35 to less than 1.40

D: smaller than 1.35

The larger the value of density, the better is the result denoted thereby.

<Fogging>

Fogging was evaluated in a low-temperature and low-humidity environment (15.0° C., 10.0% RH) which is harsh for the mechanical characteristics of toner, using the above evaluation equipment.

The measurement of fogging was carried out using REFLECTOMETER MODEL TC-6DS by Tokyo Denshoku Co., Ltd.). A green filter was used as a filter in the measurements. Herein Mylar tape was affixed to, and stripped off, the photosensitive member (photosensitive drum) for a white image immediately following output of a solid black image, and the reflectance of the tape affixed to paper was subtracted from the Mylar tape directly affixed to paper, to calculate fogging thereby. Fogging was then evaluated in accordance with the following criterion.

Fogging (%)=Reflectance (%) of the tape directly affixed to paper−Reflectance (%) of the tape that was affixed to the drum Evaluation timings were set to the first print, and to after output of 3500 prints and of 5000 prints, under the same conditions as in the evaluation method of a post-black drum.

The evaluation criteria are set out below. The results are given in Table 4-1.

A: Lower than 5%

B: From 5% to less than 10%

C: From 10% to less than 20%

D: 20% or higher

The smaller the value (%) of fogging, the better is the result denoted thereby.

Examples 2 to 14

The toners given in Table 4-1 to Table 4-2 were evaluated in the same way as in Example 1. The results are given in Table 4-1 to Table 4-2.

Examples 15 and 16

A toner supply member was affixed to a process cartridge (product name: CF230X) for a laser printer (product name: LaserJet Prom203dw, by The Hewlett-Packard Company) of an electrophotographic system, of Example 1. Toner 15 and Toner 16 were evaluated in the same way as in Example 1, but herein 120 g of each toner were filled into the process cartridge. The evaluation results are given in Table 4-2.

Example 17

A cleaner member was affixed to a cartridge (product name: CF230X) for a laser printer (product name: LaserJet Prom203dw, by The Hewlett-Packard Company) of an electrophotographic system, of Example 1, and an evaluation was carried out in the same way as in Example 1. The results are given in Table 4-2.

Comparative Examples 1 to 5

The toners given in Table 4-2 were evaluated in the same way as in Example 1. The results are given in Table 4-2.

TABLE 1

| External additive | Number-average particle diameter (nm) | SF-2 |
|---|---|---|
| A-1 | 89 | 112 |
| A-2 | 82 | 116 |
| A-3 | 104 | 115 |
| A-4 | 73 | 104 |
| A-5 | 138 | 117 |
| A-6 | 153 | 112 |
| A-7 | 126 | 110 |
| A-8 | 64 | 107 |
| A-9 | 123 | 105 |
| A-10 | 78 | 120 |
| A-11 | 185 | 130 |
| A-12 | 203 | 100 |
| A-13 | 103 | 100 |
| External additive-14 | 52 | 100 |
| External additive-15 | 223 | 100 |

TABLE 2

| Toner particle No. | Initiator (parts) | D4 (μm) | Tg (° C.) |
|---|---|---|---|
| T-1 | 7.0 | 8.0 | 55 |
| T-2 | 6.0 | 8.1 | 55 |
| T-3 | 9.5 | 8.0 | 55 |
| T-4 | 5.0 | 8.1 | 55 |
| T-5 | 4.0 | 7.9 | 55 |
| T-6 | Described in the description | 8.0 | 55 |
| T-7 | — | 7.8 | 52 |
| T-8 | — | 7.6 | 54 |

TABLE 3-1

| Toner particle | | Toner 1 T-1 | Toner 2 T-2 | Toner 3 T-1 | Toner 4 T-1 | Toner 5 T-1 | Toner 6 T-3 | Toner 7 T-4 | Toner 8 T-4 | Toner 9 T-4 | Toner 10 T-4 | Toner 11 T-3 |
|---|---|---|---|---|---|---|---|---|---|---|---|---|
| External additive | Type | A-1 | A-2 | A-3 | A-9 | A-10 | A-4 | A-5 | A-6 | A-11 | A-7 | A-2 |
| | Amount [parts] | 1.5 | 0.6 | 2.0 | 1.3 | 0.6 | 0.3 | 2.5 | 3.0 | 4.0 | 1.7 | 2.0 |
| | Coverage ratio [area %] | 22.6 | 10.0 | 29.0 | 16.3 | 6.8 | 4.0 | 35.3 | 38.4 | 50.0 | 25.8 | 29.0 |
| External additive B | Type | B-1 | B-1 | B-1 | B-1 | B-1 | B-1 | B-1 | B-1 | B-1 | B-1 | B-1 |
| | Amount [parts] | 0.3 | 0.3 | 0.3 | 0.3 | 0.3 | 0.3 | 0.3 | 0.3 | 0.3 | 0.3 | 0.3 |
| Apparatus conditions in FIG. 2 | Peripheral velocity V [m/s] | 1.0 | 1.0 | 1.0 | 1.0 | 1.0 | 2.0 | 1.0 | 1.0 | 1.0 | 1.0 | 6.6 |
| | Revolution speed [rpm] | 150 | 150 | 150 | 150 | 150 | 300 | 150 | 150 | 150 | 150 | 1000 |
| | Temperature [° C.] | 55 | 55 | 50 | 50 | 55 | 55 | 50 | 45 | 40 | 45 | 60 |
| | Treatment E [Wh/g] | $2.5 \times 10^{-3}$ | $2.5 \times 10^{-3}$ | $2.5 \times 10^{-3}$ | $2.5 \times 10^{-3}$ | $2.5 \times 10^{-3}$ | $1.5 \times 10^{-2}$ | $1.2 \times 10^{-3}$ | $1.2 \times 10^{-3}$ | $1.2 \times 10^{-3}$ | $1.2 \times 10^{-3}$ | $5.6 \times 10^{-2}$ |
| | Effective power [kW] | 0.01 | 0.01 | 0.01 | 0.01 | 0.01 | 0.04 | 0.01 | 0.01 | 0.01 | 0.01 | 0.15 |
| | Treatment amount [g] | 670 | 670 | 670 | 670 | 670 | 670 | 670 | 670 | 670 | 670 | 670 |
| | Time [minutes] | 10 | 10 | 10 | 10 | 10 | 15 | 5 | 5 | 5 | 5 | 15 |
| Toner charac-teristics | Adhesion index of external additive A | 1.22 | 1.21 | 1.42 | 1.62 | 1.53 | 1.03 | 1.82 | 2.01 | 2.71 | 2.72 | 0.92 |
| | Feret diameter a [nm] of external additive A | 86 | 80 | 100 | 120 | 75 | 70 | 135 | 150 | 180 | 120 | 80 |
| | b/(b + c) | 0.25 | 0.24 | 0.22 | 0.20 | 0.27 | 0.29 | 0.18 | 0.16 | 0.15 | 0.17 | 0.30 |
| | Standard deviation of b/(b + c) | 0.10 | 0.11 | 0.10 | 0.13 | 0.13 | 0.12 | 0.11 | 0.11 | 0.15 | 0.11 | 0.10 |
| | Protrusion height c [nm] | 64.5 | 60.8 | 78.0 | 96.0 | 54.8 | 49.7 | 110.7 | 126.0 | 153.0 | 99.6 | 56.0 |
| | Standard deviation of protrusion height c | 13 | 15 | 18 | 21 | 23 | 18 | 16 | 15 | 21 | 19 | 18 |
| | Protrusion shape V(b + c) | 0.87 | 0.85 | 0.83 | 0.80 | 0.89 | 0.91 | 0.77 | 0.73 | 0.71 | 0.75 | 0.92 |
| | Load F [mN] at maximum value of nano-indenter | 1.2 | 1.5 | 1.1 | 1.0 | 1.1 | 0.8 | 1.6 | 1.8 | 2.0 | 1.9 | 0.7 |

TABLE 3-2

| Toner particle | | Toner 12 T-5 | Toner 13 T-4 | Toner 14 T-8 | Toner 15 T-6 | Toner 16 T-7 | Toner 17 T-1 | Toner 18 T-1 | Toner 19 T-1 | Toner 20 T-8 | Toner 21 T-1 |
|---|---|---|---|---|---|---|---|---|---|---|---|
| External additive | Type | A-8 | A-12 | A-1 | A-1 | A-1 | A-13 | External additive 14 | External additive 15 | A-13 | A-13 |
| | Amount [parts] | 0.1 | 4.5 | 1.5 | 1.5 | 1.5 | 2.0 | 1.5 | 3.0 | 1.5 | 2.0 |
| | Coverage ratio [area %] | 3.2 | 51.5 | 22.5 | 21.3 | 20.6 | 22.4 | 16.3 | 35.3 | 16.3 | 22.4 |
| External additive B | Type | B-1 | B-1 | B-1 | B-1 | B-1 | B-1 | B-1 | B-1 | B-1 | B-1 |
| | Amount [parts] | 0.3 | 0.3 | 0.3 | 0.3 | 0.3 | 0.3 | 0.3 | 0.3 | 0.3 | 0.3 |

TABLE 3-2-continued

| Toner particle | | Toner 12 T-5 | Toner 13 T-4 | Toner 14 T-8 | Toner 15 T-6 | Toner 16 T-7 | Toner 17 T-1 | Toner 18 T-1 | Toner 19 T-1 | Toner 20 T-8 | Toner 21 T-1 |
|---|---|---|---|---|---|---|---|---|---|---|---|
| Apparatus conditions in FIG. 2 | Peripheral velocity V [m/s] | 0.3 | 7.3 | 1.0 | 1.0 | 1.0 | Described in the description | Described in the description | Described in the description | Described in the description | 1.0 |
| | Revolution speed [rpm] | 50 | 1100 | 150 | 150 | 150 | | | | | 150 |
| | Temperature [° C.] | 65 | 55 | 55 | 55 | 55 | | | | | 25 |
| | Treatment E [Wh/g] | $1.2 \times 10^{-3}$ | $5.6 \times 10^{-2}$ | $2.5 \times 10^{-3}$ | $2.5 \times 10^{-3}$ | $2.5 \times 10^{-3}$ | | | | | $5.0 \times 10^{-4}$ |
| | Effective power [kW] | 0.01 | 0.15 | 0.01 | 0.01 | 0.01 | | | | | 0.01 |
| | Treatment amount [g] | 670 | 670 | 670 | 670 | 670 | | | | | 670 |
| | Time [minutes] | 5 | 15 | 10 | 10 | 10 | | | | | 2 |
| Toner characteristics | Adhesion index of external additive A | 1.29 | 2.67 | 1.25 | 1.24 | 1.26 | 1.01 | — | — | 1.89 | 3.50 |
| | Feret diameter a [nm] of external additive A | 60 | 200 | 80 | 83 | 84 | 100 | — | — | 100 | 100 |
| | b/(b + c) | 0.15 | 0.30 | 0.26 | 0.23 | 0.24 | 0.33 | — | — | 0.35 | 0.13 |
| | Standard deviation of b/(b + c) | 0.11 | 0.15 | 0.11 | 0.10 | 0.10 | 0.16 | — | — | 0.18 | 0.11 |
| | Protrusion height c [nm] | 51.0 | 140.0 | 59.2 | 63.9 | 63.8 | 67.0 | — | — | 65.0 | 87.0 |
| | Standard deviation of protrusion height c | 16 | 26 | 16 | 18 | 16 | 23 | — | — | 27 | 25 |
| | Protrusion shape l/(b + c) | 0.71 | 0.92 | 0.88 | 0.84 | 0.85 | 0.94 | — | — | 0.95 | 0.67 |
| | Load F [mN] at maximum value of nano-indenter | 2.2 | 1.6 | 1.0 | 1.1 | 1.2 | 0.7 | 0.7 | 0.7 | 0.8 | 0.9 |

TABLE 4-1

| | | Examples | | | | | | | | | | |
|---|---|---|---|---|---|---|---|---|---|---|---|---|
| Toner No. | | 1 Toner 1 | 2 Toner 2 | 3 Toner 3 | 4 Toner 4 | 5 Toner 5 | 6 Toner 6 | 7 Toner 7 | 8 Toner 8 | 9 Toner 9 | 10 Toner 10 | 11 Toner 11 |
| Transfer evaluation | Initial | A | A | A | A | A | A | A | B | C | B | C |
| | | 2.6 | 3.1 | 3.0 | 3.9 | 4.2 | 4.8 | 4.7 | 5.8 | 10.3 | 8.9 | 11.3 |
| | At 3500 prints | A | A | A | A | B | B | B | B | C | B | C |
| | | 3.5 | 3.8 | 3.6 | 4.7 | 5.1 | 5.9 | 6.8 | 7.2 | 11.6 | 9.3 | 12.6 |
| | At 5000 prints | A | A | A | B | B | B | B | B | C | C | C |
| | | 4.2 | 4.6 | 4.5 | 5.2 | 6.2 | 7.8 | 8.3 | 8.6 | 12.5 | 12.9 | 13.8 |
| Scattering evaluation | Initial | A | A | A | A | A | A | A | A | A | A | A |
| | At 3500 prints | A | A | A | A | A | B | A | A | A | A | B |
| | At 5000 prints | A | A | A | A | B | B | A | A | A | A | C |
| Durability density | Initial | A | A | A | B | B | B | A | A | B | A | A |
| | | 1.47 | 1.46 | 1.46 | 1.44 | 1.44 | 1.43 | 1.46 | 1.46 | 1.41 | 1.47 | 1.46 |
| | At 3500 prints | A | A | A | B | B | B | A | A | C | A | A |
| | | 1.46 | 1.46 | 1.45 | 1.43 | 1.42 | 1.42 | 1.45 | 1.45 | 1.37 | 1.46 | 1.45 |
| | At 5000 prints | B | B | B | B | C | B | B | B | C | B | B |
| | | 1.43 | 1.44 | 1.42 | 1.41 | 1.37 | 1.41 | 1.43 | 1.42 | 1.36 | 1.41 | 1.42 |
| Fogging | Initial | A | A | A | A | A | A | A | A | A | A | B |
| | | 3.5 | 3.6 | 3.8 | 3.7 | 4.1 | 4.2 | 4.8 | 4.6 | 4.2 | 4.3 | 6.5 |
| | At 3500 prints | A | A | A | A | A | B | B | B | B | B | C |
| | | 4.2 | 4.3 | 4.4 | 4.6 | 4.6 | 7.8 | 6.5 | 7.2 | 8.3 | 6.3 | 10.3 |
| | At 5000 prints | B | B | B | B | B | C | B | B | C | B | C |
| | | 5.6 | 6.1 | 6.3 | 6.9 | 6.8 | 10.3 | 8.2 | 9.3 | 10.3 | 8.9 | 15.3 |

TABLE 4-2

| | | Examples | | | | | | Comparative Examples | | | | |
|---|---|---|---|---|---|---|---|---|---|---|---|---|
| | | 12 | 13 | 14 | 15 | 16 | 17 | 1 | 2 | 3 | 4 | 5 |
| Toner No. | | Toner 12 | Toner 13 | Toner 14 | Toner 15 | Toner 16 | Toner 1 | Toner 17 | Toner 18 | Toner 19 | Toner 20 | Toner 21 |
| Transfer evaluation | Initial | B | C | C | A | A | A | D | D | C | D | C |
| | | 9.8 | 12.6 | 11.5 | 3.8 | 4.1 | 2.5 | 15.3 | 18.3 | 14.8 | 15.6 | 14.5 |
| | At 3500 | C | C | C | A | A | A | D | D | D | D | D |
| | prints | 13.5 | 13.8 | 13.5 | 4.3 | 4.8 | 3.1 | 16.1 | 19.6 | 15.6 | 16.8 | 15.6 |
| | At 5000 | C | C | C | B | B | A | D | D | D | D | D |
| | prints | 14.9 | 14.3 | 14.8 | 5.2 | 7.6 | 3.6 | 17.1 | 20.5 | 17.3 | 17.1 | 18.5 |
| Scattering evaluation | Initial | A | A | A | A | A | A | D | C | B | D | B |
| | At 3500 prints | A | B | A | A | A | A | D | D | C | D | C |
| | At 5000 prints | A | C | A | A | A | A | D | D | D | D | D |
| Durability density | Initial | A | B | A | A | A | A | A | A | A | A | A |
| | | 1.46 | 1.42 | 1.46 | 1.46 | 1.45 | 1.48 | 1.46 | 1.46 | 1.45 | 1.45 | 1.45 |
| | At 3500 | B | B | A | A | A | A | B | B | B | B | B |
| | prints | 1.42 | 1.41 | 1.45 | 1.45 | 1.45 | 1.47 | 1.43 | 1.42 | 1.41 | 1.40 | 1.41 |
| | At 5000 | B | C | B | B | B | B | B | B | B | B | B |
| | prints | 1.41 | 1.38 | 1.43 | 1.42 | 1.41 | 1.44 | 1.40 | 1.41 | 1.40 | 1.41 | 1.40 |
| Fogging | Initial | A | B | A | A | A | A | A | A | A | A | A |
| | | 4.8 | 6.5 | 4.8 | 4.6 | 4.4 | 2.5 | 4.6 | 4.5 | 4.9 | 4.6 | 4.6 |
| | At 3500 | B | B | B | B | B | A | C | C | C | B | B |
| | prints | 7.9 | 8.3 | 7.3 | 8.9 | 7.5 | 3.5 | 10.6 | 10.8 | 10.4 | 7.9 | 7.9 |
| | At 5000 | C | C | C | C | C | A | C | C | C | C | C |
| | prints | 10.5 | 11.1 | 10.6 | 10.8 | 10.8 | 4.5 | 15.7 | 16.1 | 15.3 | 10.8 | 11.5 |

The present invention succeeds in providing a toner that is not prone to scatter, and that is superior in transfer efficiency during formation of line images under conditions of low transfer current.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A toner, comprising:

a toner particle comprising a binder resin and a colorant; and an external additive, comprising an external additive A;

external additive A being inorganic fine particles or organic-inorganic composite fine particles having a Feret diameter of 60 to 200 nm;

a shape factor SF-2 of external additive A being 100 to 120 measured by a scanning electron microscope; and an adhesion index of external additive A to the toner being 0.00 to 3.00, wherein $60 \leq b+c \leq 200$ and $0.15 \leq b/(b+c) \leq 0.30$, where b (nm) denotes a penetration depth of the external additive A at a portion of the external additive A penetrating into the interior of the toner particle from the surface of the toner particle, and c (nm) denotes a protrusion height of the external additive A at that portion in an observation of an image resulting from image processing of a cross section of the toner using a transmission electron microscope, and where with an outline X defined as the outline of a portion of contact of external additive A with the toner particle, in the outline of external additive A, and a line segment Z defined as the line segment obtained by joining both ends of the outline X with a straight line, in the observation of the image resulting from image processing of the cross section, penetration depth b denotes a maximum distance between the line segment Z and an intersection of the outline X and a perpendicular line front the line segment Z to the outline X; and with an outline Y defined as the outline of a portion other than the outline X in the outline of the external additive A, in the observation of the image resulting from image processing of the cross section, protrusion height c denotes a maximum distance between the line segment Z and an intersection of the outline Y and a perpendicular line from the line segment Z to the outline Y.

2. The toner according to claim 1, wherein a coverage ratio of the toner particle by the external additive A is 4.0 to 50.0 area %.

3. The toner according to claim 1, wherein in a measurement of the strength of the toner in accordance with a nanoindentation method, a load F at a maximum value is 0.8 to 2.0 mN in a load region from 0.20 to 2.30 mN of a differential curve obtained through differentiating, by load, of a load-displacement curve with load (mN) on the horizontal axis and displacement amount (μm) on the vertical axis.

4. The toner according to claim 1, wherein the standard deviation of b/(b+c) is 0.00 to 0.13.

5. The toner according to claim 1, wherein c is 50.0 to 150.0 nm.

6. The toner according to claim 1, wherein the standard deviation of c is 0 to 30.

7. The toner according to claim 1, wherein l/(b+c) is 0.70 to 0.92, where l (nm) is the length of line segment Z.

8. The toner according to claim 1, wherein the adhesion index of external additive A to the toner is 0.10 to 2.50.

9. A toner, comprising:

a toner particle comprising a binder resin and a colorant; and an external additive comprising an external additive A;

external additive A being inorganic line particles or organic-inorganic composite tine particles having a Feret diameter of 60 to 200 nm; and an adhesion index of external additive A to the toner being 0.00 to 3.00, wherein $60 \leq b \div c \leq 200$ and $0.15 \leq b/(b+c) \leq 0.30$, where b (nm) denotes a penetration depth of external additive A at a portion of external additive A penetrating into the interior of the toner particle from the surface of the toner particle, and c (nm) denotes a protrusion height of external additive A at that portion in an observation of an image resulting from image processing of a cross section of the toner using a transmission electron microscope, where with an outline X defined as the outline of a portion of contact of external additive A with the toner particle, in the outline of external additive A, and a line segment Z defined as the line segment obtained by joining both ends of the outline X with a straight line, in the observation of the image resulting from image processing of the cross section, penetration depth b denotes a maximum distance bets een the line segment Z and an intersection of the outline X and a perpendicular line from he line segs segment Z to the outline X; and with an outline Y defined as the outline of a portion other than the outline X in the outline of the external additive A, in the observation of the image resulting from image processing of the cross section, protrusion height c denotes a maximum distance between the line segment Z and an intersection of the outline Y and a perpendicular line from the line segment Z to the outline Y, and in a measurement of the strength of the toner in accordance with a nanoindentation method, a load F at a maximum value is 0.8 to 2.0 mN in a load region from 0.20 to 2.30 mN of a differential curve obtained through differentiating, by load, of a load-displacement curve ith load (mN) on the horizontal axis and displacement amount (μ) on the vertical axis.

10. A toner, comprising:

a toner particle comprising a binder resin and a colorant; and an external additive comprising an external additive A;

external additive A being inorganic fine particles or organic-inorganic composite tine particles having a Feret diameter of 60 to 200 nm; and an adhesion index of external additive A to the toner being 0.00 to 3.00, wherein $60 \leq b+c \leq 200$ and $0.15 \leq b/(b+c) \leq 0.30$, where b (nm) denotes a penetration depth of external additive A at a portion. of external additive A penetrating into the interior of the toner particle from the surface of the toner particle, and c (nm) denotes a protrusion height of external additive A at that portion in an observation of an image resulting from image processing of a cross section of the toner using a transmission electron microscope, where with an outline X defined as the outline of a portion of contact of external additive A with the toner particle, in the outline of external additive A, and a line segment Z defined as the line segment obtained by joining both ends of the outline X with a straight line, in the observation of the image resulting from image processing of the cross section, penetration depth b denotes a maximum distance between the line segment Z and an intersection of the outline X and a perpendicular line from the line segment Z to the outline X; and with an outline Y defined as the outline of a portion other than the outline X in the outline of the external additive A, in the observation of the image resulting from image processing of the cross section, protrusion height c denotes a maximum distance between the line segment Z and an intersection of the outline Y and a perpendicular line from the line segment Z to the outline Y, and $l/(b+c)$ is 0.70 to 0.92, where l (nm) is the length of line segment Z.

* * * * *